US006213926B1

(12) United States Patent
Weder et al.

(10) Patent No.: US 6,213,926 B1
(45) Date of Patent: Apr. 10, 2001

(54) APPARATUS AND METHOD FOR AUTOMATICALLY FORMING AN ARTICLE

(75) Inventors: Donald E. Weder; Joseph G. Straeter, both of Highland; William F. Straeter, Breese, all of IL (US); Frank Craig, Valley Park, MO (US); Michael J. King, Staunton, IL (US); William C. Funk, San Francisco, CA (US)

(73) Assignee: Southpac Trust International, Inc.

( * ) Notice: Subject to any disclaimer, the term of this patent is extended or adjusted under 35 U.S.C. 154(b) by 0 days.

(21) Appl. No.: 09/519,059

(22) Filed: Mar. 3, 2000

Related U.S. Application Data

(63) Continuation of application No. 09/293,568, filed on Apr. 15, 1999, now Pat. No. 6,056,679, which is a continuation of application No. 09/009,632, filed on Jan. 20, 1998, now Pat. No. 5,944,646, which is a continuation of application No. 08/680,348, filed on Jul. 17, 1996, now Pat. No. 5,795,281.

(51) Int. Cl.[7] ..... B31B 1/44

(52) U.S. Cl. ..... 493/154; 493/167; 425/387.1; 425/388

(58) Field of Search ..... 493/154, 167, 493/168, 170, 171, 174, 256; 425/387.1, 388, 150; 264/40.2, 554

(56) References Cited

U.S. PATENT DOCUMENTS

| | | | | |
|---|---|---|---|---|
| 939,888 | | 11/1909 | Bertin | 493/167 |
| 1,716,554 | | 6/1929 | Hoff, Jr. | 493/167 |
| 2,017,054 | | 10/1935 | Brunn | 493/167 |
| 2,848,927 | | 8/1958 | Franghia | 493/154 |
| 3,007,377 | | 11/1961 | Muller | 493/154 |
| 3,105,270 | | 10/1963 | Fibish | 18/19 |
| 3,228,066 | | 1/1966 | Rippstein | 18/19 |
| 3,465,384 | | 9/1969 | Barchi | 18/4 |
| 3,550,421 | | 12/1970 | Stakel | 493/167 |
| 3,674,399 | | 7/1972 | Sendor | 425/166 |
| 3,973,888 | | 8/1976 | Hehl | 425/125 |
| 4,106,884 | | 8/1978 | Jegelka | 425/345 |
| 4,235,160 | | 11/1980 | Olney | 493/154 |
| 4,440,702 | | 4/1984 | Susnjara | 264/37 |
| 4,479,914 | | 10/1984 | Baumrucker | 264/45.5 |
| 4,755,128 | | 7/1988 | Alexander et al. | 425/292 |
| 4,773,182 | | 9/1988 | Weder et al. | 47/72 |
| 4,778,372 | | 10/1988 | Mutti et al. | 425/294 |
| 4,887,805 | | 12/1989 | Herbert et al. | 271/94 |
| 4,889,331 | | 12/1989 | Sardella | 271/11 |
| 4,939,350 | | 7/1990 | Sauer | 235/98 |
| 4,963,087 | | 10/1990 | Aida et al. | 425/556 |
| 5,014,972 | | 5/1991 | Anderson | 271/3.1 |
| 5,044,918 | | 9/1991 | Brussel | 425/397 |
| 5,052,675 | | 10/1991 | Shehata et al. | 271/98 |
| 5,073,161 | | 12/1991 | Weder et al. | 493/154 |
| 5,076,874 | | 12/1991 | Weder | 156/212 |
| 5,090,676 | | 2/1992 | Matsuno et al. | 271/12 |
| 5,176,609 | | 1/1993 | Weder et al. | 493/154 |
| 5,221,248 | * | 6/1993 | Weder et al. | 493/154 |
| 5,238,382 | | 8/1993 | Weder et al. | 425/150 |
| 5,286,246 | | 2/1994 | Weder et al. | 493/154 |
| 5,286,247 | * | 2/1994 | Weder et al. | 493/154 |
| 5,291,721 | | 3/1994 | Weder et al. | 53/580 |
| 5,350,349 | | 9/1994 | Weder et al. | 493/154 |
| 5,523,046 | * | 6/1996 | Weder et al. | 493/154 |
| 5,575,746 | * | 11/1996 | Weder et al. | 493/154 |
| 5,725,468 | * | 3/1998 | Weder et al. | 493/154 |
| 5,766,525 | | 6/1998 | Andersen et al. | 264/40.2 |
| 5,776,525 | | 6/1998 | Andersen et al. | 254/40.1 |
| 5,794,405 | | 8/1998 | Weder | 493/154 |
| 5,944,646 | * | 8/1999 | Weder et al. | 493/154 |

* cited by examiner

*Primary Examiner*—Eugene Kim
(74) *Attorney, Agent, or Firm*—Dunlap, Codding & Rogers, P.C.

(57) ABSTRACT

An apparatus and method for forming a sheet of material into an article, such as a flower pot cover, is provided. The apparatus includes a female die and a male die. A sheet of material is positioned between the male die and the female die. The male and female dies are shaped such that at least a portion of the male die is receivable in the opening of the female die to form the article. The apparatus further includes means for supplying a stream of air between the female die and the formed article to release the formed article from the female die and means for holding the formed article against the male die as the male die and the female die are positioned from a forming position to a discharge position whereby the formed article is removed from the female die.

2 Claims, 18 Drawing Sheets

APPARATUS AND METHOD FOR AUTOMATICALLY FORMING AN ARTICLE

CROSS-REFERENCE TO RELATED APPLICATIONS

This application is a continuation of U.S. Ser. No. 09/293,568, filed Apr. 15, 1999, now U.S. Pat. No. 6,056,679 which is a continuation of U.S. Ser. No. 09/009,632, filed Jan. 20, 1998, now U.S. Pat. No. 5,944,646, which is a continuation of U.S. Ser. No. 08/680,348, filed Jul. 17, 1996, now U.S. Pat. No. 5,795,281.

STATEMENT REGARDING FEDERALLY SPONSORED RESEARCH OR DEVELOPMENT

Not applicable.

BACKGROUND OF THE INVENTION

The present invention relates generally to an article forming apparatus, and more particularly, but not by way of limitation, to an improved apparatus and method for automatically forming an article, such as a flower pot cover, from one or more sheets of material.

BRIEF DESCRIPTION OF THE SEVERAL VIEWS OF THE DRAWING

FIG. 6 is a partially cross sectional, side view of the article forming apparatus of the present invention shown with the near side frame member removed for clarity.

FIG. 9 is a top perspective view of a portion of the article forming apparatus illustrating the conveyor assembly.

FIG. 16C is a perspective view of a portion of the article forming apparatus illustrating the stacking assembly.

DETAILED DESCRIPTION OF THE INVENTION

The present invention is generally directed to an apparatus for automatically forming an article having a predetermined shape from a sheet of material which is commonly referred to in the art as a "film". The sheet of material contemplated to be used with the present invention is fabricated from a polymeric material selected from a group consisting of polypropylene, polyvinyl chloride, or combinations thereof. The sheet of material contemplated to be used with the present invention is also relatively thin having a thickness in a range from about 0.5 mils to about 30 mils, and the sheet of material is very flexible and flimsy so that the sheet of material will not normally maintain or hold a predetermined formed shape (non-shape sustaining). The present invention provides a means for forming a sheet of material of the type just described into a predetermined shape so the formed sheet of material substantially retains or maintains the formed shape thereby providing a means for making articles from such sheets of material in a more economical manner.

Figure 1:
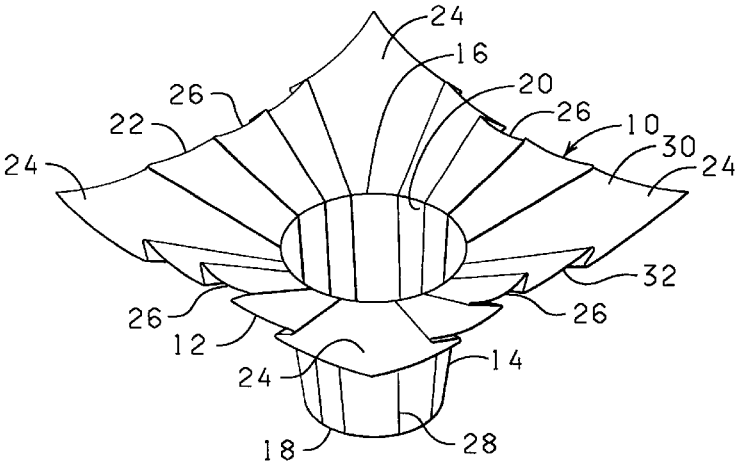
FIG. 1 is a perspective view of a flower pot cover constructed in accordance with the present invention.

Two examples of articles that can be formed using an automatic article forming apparatus constructed in accordance with the present invention are illustrated in FIGS. 1–4. More particularly, FIG. 1 illustrates a flower pot cover 10 preferably, although not exclusively, formed from a generally square-shaped sheet of material 12. The flower pot cover 10 includes a base 14 having an opened upper end 16, a closed lower end 18, an object opening 20 extending through the upper end 16 and a decorative border 22 which extends angularly upwardly and outwardly from the upper end 16 of the base 14. The decorative border 22 includes four accentuated and sculptured flared petal-like portions 24. Each flared petal-like portion 24 terminates with a pointed end which is formed by one of the four corners of the square-shaped sheet of material 12. Further, each flared-like petal portion 24 extends a distance angularly upwardly and outwardly from the upper end 16 of the base 14 terminating with the pointed end of the flared petal-like portion 24. The flared petal-like portions 24 are spaced apart circumferentially about the decorative border 22 with the flared petal-like portions 24 being spaced apart at about ninety degree intervals, and a flare connecting portion 26 disposed between each pair of adjacent flared petal-like portions 24. Each of the flare connecting portions 26 extends a distance angularly upwardly and outwardly from the upper end 16 of the base 14 less than the distances which the pointed ends of the flared petal-like portions 24 extend from the upper end 16 of the base 14.

The object opening 20 of the flower pot cover 10 is shaped and sized to receive a flower pot (not shown). When a flower pot is disposed in the object opening 20 of the flower pot cover 10, the base 14 substantially encompasses the outer peripheral surface of the flower pot extending generally between the upper and the lower ends of the flower pot with the upper end 16 of the base 14 being disposed generally near the upper end of the flower pot and the lower end 18 of the flower pot cover 10 being disposed generally near the lower end of the flower pot. The closed lower end 18 of the flower pot cover 10 extends across and encompasses the lower end of the flower pot. When the flower pot cover 10 is disposed about the flower pot, the decorative border 22 of the flower pot cover 10 extends a distance angularly upwardly and outwardly from the upper end of the flower pot and the flower pot cover 10 extends generally circumferentially about the upper end of the flower pot.

The base 14 of the flower pot cover 10 includes a plurality of overlapping folds 28 (only some of the overlapping folds 28 being designated by a reference numeral in the drawings). A substantial portion of the overlapping folds 28 extend at angles to a vertical direction and at angles to a horizontal direction, the various angles being arbitrary and varying from one overlapping fold 28 to another overlapping fold 28. Further, the base 14 includes a plurality of overlapping folds 28 with the various overlapping folds 28 being positioned at various positions about the entire outer peripheral surface of the base 14 and at various positions between the upper and the lower ends 16 and 18 of the base 14. The overlapping folds 28 provide an overall decorative appearance to the base 14. However, more significantly, the overlapping folds 28 provide a mechanical strength to the base 14 for enabling the base 14 to stand upright (substantially retain the shape formed by the apparatus of the present invention described below) on the closed lower end 18 of the base 14. In this manner, the base 14 of the flower pot cover 10 has sufficient mechanical strength to stand upright about a flower pot without the necessity of mechanically connecting the base 14 to a flower pot, other than the connection normally provided when the lower end of a flower pot engages the lower end 18 of the flower pot cover 10 when the flower pot cover 10 is disposed about a flower pot.

Each overlapping fold 28 extends an arbitrary distance and most of the overlapping folds 28 extend at arbitrary angles over the base 14 which enhances the mechanical strength of the base 14 as compared to the mechanical strength which might be imparted to the base 14 by overlapping folds extending only in vertical or horizontal directions. Significantly, the overlapping folds 28 permit relatively thin sheets (films) of material to be utilized to form the decorative flower pot cover 10, in a manner and for reasons to be discussed further below.

The sheet of material 12 has an upper surface 30 and a lower surface 32, and either the upper surface 30 or the lower surface 32 or both the upper surface 30 and the lower surface 32 is adapted to be bondable so that when portions of the bondable surface are brought into bondable contact, such portions are bondably connected. The overlapping folds 28 are formed by overlapping portions of the bondable surface and bringing such overlapping portions into bondable engagement or contact. In this manner, the overlapping folds 28 are permanently fixed in the flower pot cover 10. When an overlapping fold 28 is formed with a portion of the sheet of material 12 during the forming of the flower pot cover 10, portions of the upper surface 30 are overlapped and brought into bondable contact or engagement and, with respect to the same overlapping fold 28, portions of the lower surface 32 also are overlapped and brought into bondable contact or engagement.

As mentioned before, at least one of the upper and the lower surfaces 30 and 32 is prepared to form a bondable surface which is adapted to be bonded to portions of a similar bondable surface when bondably contacted with a similar bondable surface portion. Thus, in those instances when only the lower surface 32 is prepared to form a bondable lower surface 32, the overlapping portions of the bondable lower surface 32 are brought into bondable contact during the forming of the flower pot cover 10 and such overlapping portions are bonded to form the overlapping folds 28. The corresponding overlapping portions of the upper surface 30 are not bonded. Similarly, in those instances when only the upper surface 30 is prepared to form a bondable upper surface 30, the overlapping portions of the bondable upper surface 30 are brought into bondable contact during the forming of the flower pot cover 10 and such overlapping portions are bonded to form the overlapping folds 28. The corresponding overlapping portions of the lower surface 32 are not bonded. Finally, in those instances when both the upper and the lower surfaces 30 and 32 are prepared to form bondable upper and lower surfaces 30 and 32, the overlapping portions of the upper and the lower surfaces 30 and 32 forming each overlapping fold 28 are brought into bondable contact during the forming of the flower pot cover 10 and such overlapping portions of the upper and the lower surfaces 30 and 32 are bonded to form the overlapping folds 28.

It has been found to be necessary only to prepare one of the upper and the lower surfaces 30 or 32 to form a bondable surface so the flower pot cover 10 is formable from the film sheet of material 12 having sufficient mechanical strength to retain its formed shape in accordance with the present invention. However, it should be noted that preparing both the upper and the lower surfaces 30 and 32 to form bondable surfaces provides additional mechanical strength which may be desired in some applications and particularly in those applications where the additional mechanical strength is needed to enable the formed article to maintain or retain its formed shape. Such additional strength may be desired either because of the particular shape of the article or the particular thickness or characteristics of the particular film forming the sheet of material 12. Various techniques are utilized to prepare the sheet of material 12 with at least one bondable surface in accordance with the present invention.

One technique for preparing the bondable surfaces is to utilize polyvinyl chloride film to form the sheet of material 12 which is heat sealable. When utilizing a processed organic polymer heat sealable film, the upper and the lower surfaces 30 and 32 of the sheet of material 12 are bondable surfaces and the sheet of material 12 must be heated during the forming of the article or, more particularly, the forming of overlapping folds 28. Thus, in this instance, the term "bondable contact" or "bondable engagement" means contacting engagement and the application of the required amount of heat to effect heat sealable bonding of the contacting surfaces.

It should be noted that a light activated adhesive also is suitable for use in preparing the bondable surface in accordance with the present invention. In this instance, heating elements would not be necessary; however, means for lighting the areas to be bonded would be necessary which might be effected by utilizing a light source during the forming of the flower pot cover 10. In this instance, the term "bondable contact" or "bondable engagement" means contacting engagement and the applications of sufficient light to effect the bond.

Another technique for preparing the bondable surfaces is to utilize a non-heat sealable film to form the sheet of material 12 and to apply a heat sealable coating to either the upper surface 30 or the lower surface 32 or both. Heat sealable adhesives are commercially available. The term "bondable contact" or "bondable engagement" as used in this instance means contacting engagement and the application of the required amount of heat to effect heat sealable bonding of the contacting surfaces. The heat sealable coating also can be a heat sealable lacquer, a pressure sensitive adhesive which also requires heat to effect the bond, or a non-melt adhesive.

An additional technique for preparing the bondable surfaces 30 or 32 is to utilize a non-heat sealable film to form the sheet of material 12 and to apply a contact adhesive coating to either the upper surface 30 or the lower surface 32 or both. Contact adhesives are commercially available. The term "bondable contact" or "bondable engagement" in this instance means contacting engagement sufficient to effect the adhesive bond between the contacted surfaces.

For aesthetic purposes, it is preferable that the decorative border 22 and particularly the flared petal-like portions 24 remain substantially smooth and substantially free of the overlapping folds. Also, it is desirable that the flare connecting portions 26 also remain substantially smooth and substantially free of overlapping folds.

Figure 2:
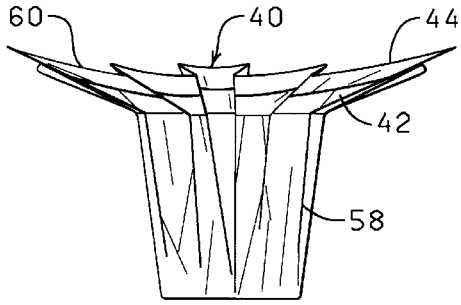
FIG. 2 is an elevational view of another flower pot cover constructed in accordance with the present invention.

It may be desirable to utilize more than one sheet of material to form a flower pot cover. FIG. 2 shows a flower pot cover 40 which is constructed from a first sheet of material 42 layered with a second sheet of material 44. It will be appreciated that the flower pot cover 40 is similar in construction to the flower pot cover 10 described above with the exception that the flower pot cover 40 is formed from two layered sheets of material rather than only one sheet of material.

Figure 3:
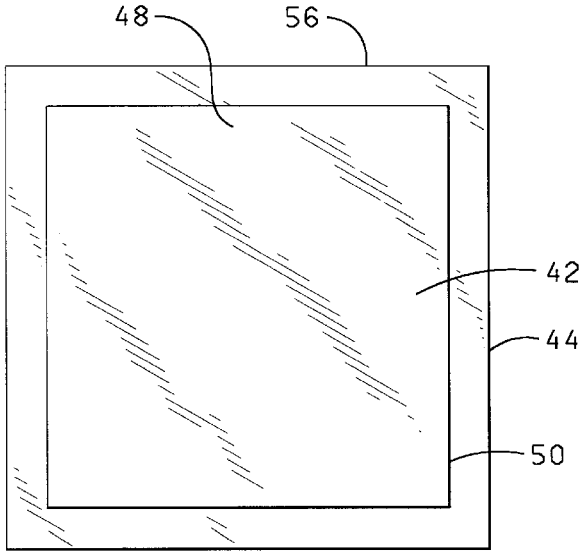
FIG. 3 is a bottom view of two layered sheets of material.
Figure 4:
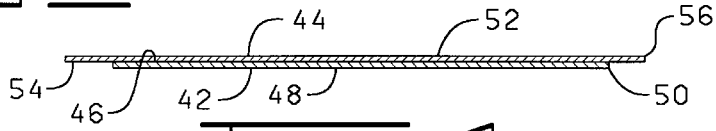
FIG. 4 is a cross sectional view of the two sheets of material in FIG. 3.

The first sheet of material 42 is generally square or rectangularly shaped and has an upper surface 46, a lower surface 48 and an outer peripheral edge 50 (FIGS. 3 and 4). Likewise, the second sheet of material 44 is generally square or rectangularly shaped and has an upper surface 52, a lower surface 54 and an outer peripheral edge 56 (FIGS. 3 and 4). In the flower pot cover 40 illustrated in FIG. 2, the first sheet of material 42 has an area encompassed by the outer peripheral edge 50 which is less than the area of the second sheet of material 44 encompassed by the outer peripheral edge 56 such that the second sheet of material 44 extends a distance outwardly from the peripheral edge 50 of the first sheet of material 42 when the first sheet of material 42 is disposed on the second sheet of material 44.

As shown in FIG. 3, the first sheet of material 42 is concentrically positioned on the upper surface 52 of the second sheet of material 44. In this position, the first sheet of material 42 and the second sheet of material 44 are formed into the flower pot cover 40 in a manner exactly like that described before in connection with the forming of the flower pot cover 10 described above. As such, the flower pot cover 40 has a plurality overlapping folds 58 (FIG. 2) which are formed in both the first and second sheets of material 42, 44 such that the first and second sheets of material 42, 44 are bondingly interlocked by the overlapping folds.

Due to the first sheet of material 42 being sized so that the second sheet of material 44 extends a distance outwardly from the peripheral edge 50 of the first sheet of material 42, an extended decorative border 60 is formed by the second sheet of material 44. It will be appreciated that the extended decorative border 60 accentuates the overall appearance of the flower pot cover 40, particularly when the second sheet of material 44 is of a compatible color and/or pattern with respect to the first sheet of material 42. However, it will also be appreciated that a flower pot cover constructed of more than one sheet of material is not limited to the construction described above. For example, the sizes of the sheets of material can be varied so that the first sheet of material is larger than the second sheet of material or so that the first and second sheets of material are of identical size.

As described above, one advantageous use of the present invention is to form flower pot covers, such as the flower pot covers 10 and 40 described above. However, it will be understood that a flower pot cover represents only one article which can be formed into a predetermined shape in accordance with the present invention and that the present invention specifically contemplates various and numerous other types of articles such as vases, hats, saucers, easter baskets, containers for use in microwave ovens, rose stem boxes, egg cartons, potting trays, pans, trays, bowls, basket liners, candy trays, drinking cups, candy cups, flower pots, planter trays for growing plants, disposable bowls and dishes, corsage boxes and containers, food service trays (such as those used for bakery goods, french fries, ground beef, liver and other raw meats in supermarkets, for example), boxes for hamburgers or pies and the like, and various other articles. The term "article" as used herein is intended to encompass all the specific articles just mentioned and the term "article" also is intended to be broad enough to encompass any other article having a predetermined shape which the article must substantially maintain in order to function as intended.

Figure 5:
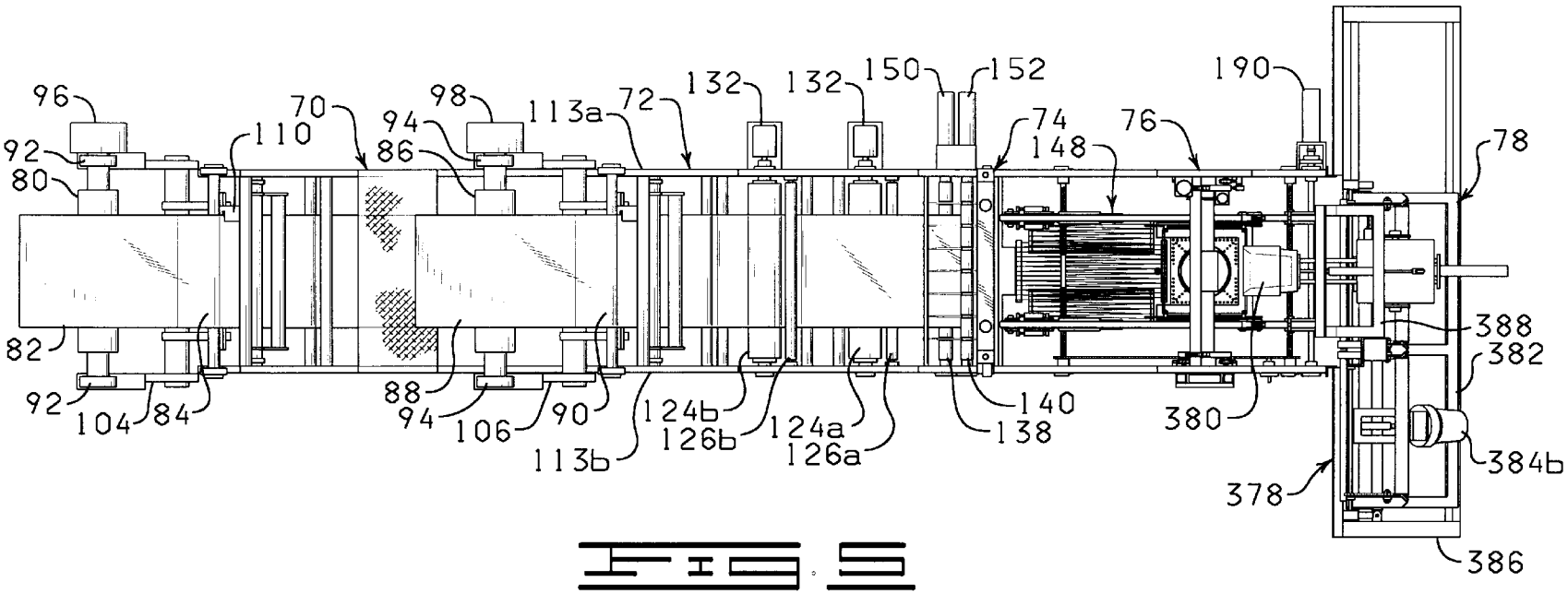
FIG. 5 is a top view of an article forming apparatus constructed in accordance with the present invention.
Figure 5:
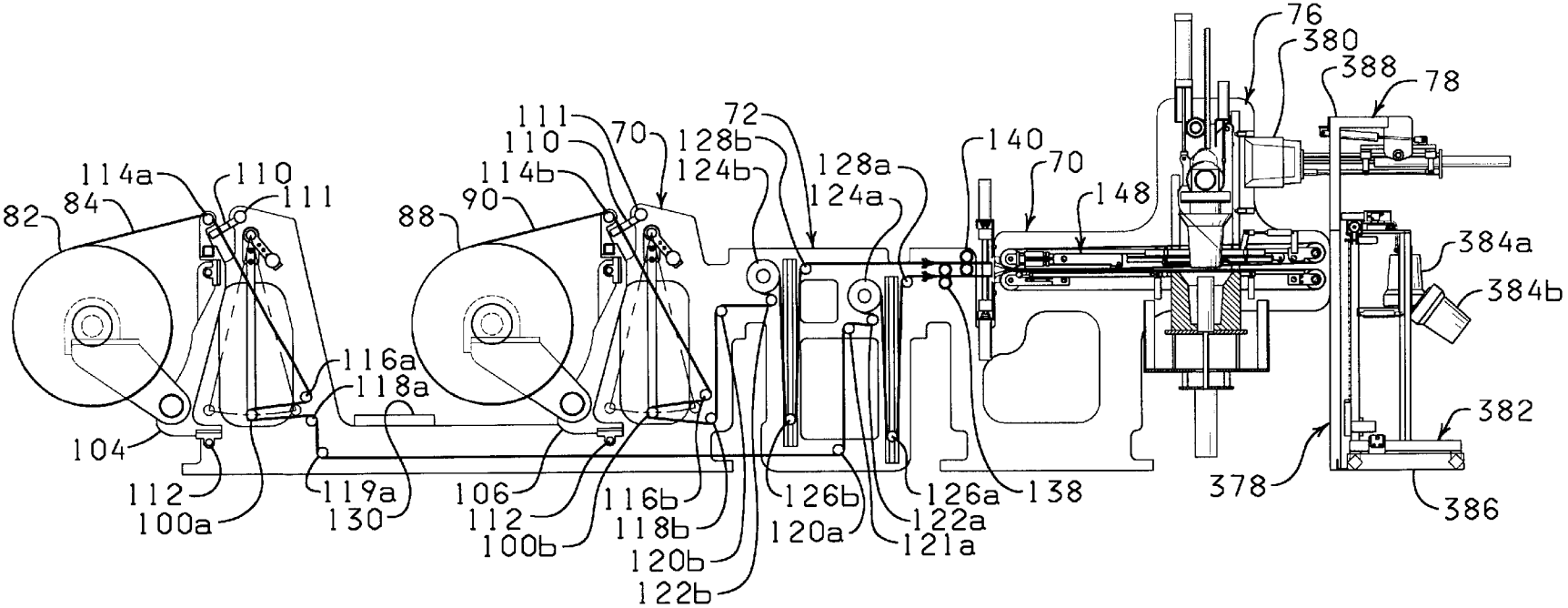

Referring now to FIGS. 5 and 6, an article forming apparatus 70 constructed in accordance with the present invention is illustrated. The article forming apparatus 70 is adapted to automatically form at least one sheet of material into an article, such as the flower pot cover 10 and the flower pot cover 40. The article forming apparatus 70 includes a sheet material delivery assembly 72, a cutting and transfer assembly 74, a molding assembly 76, and a stacking assembly 78.

The sheet material delivery assembly 72 includes a first arbor 80 for rotatably supporting a first roll of sheet material 82 providing a first web of sheet material 84 and a second arbor 86 for rotatably supporting a second roll of sheet material 88 providing a second web of sheet material 90. Each of the arbors 80 and 86 is an expandable arbor mounted and clamped between arbor mounting bearings 92 and 94, respectively. The unwind tension of the arbors 80, 86 is controlled by an air brake 96 and an air brake 98, respectively. The air brake 96 is controlled by movement of a dancer roller 100*a* and the air brake 98 is controlled by movement of a dancer roller 100*b*. More specifically, proximity sensors (not shown) are mounted to detect movement of the dancer rollers 100*a* and 100*b* and thus release the air brakes 96 and 98 accordingly.

The first arbor 80 is mounted on a slide base 104 which permits the first roll of sheet material 82 to be moved from side to side as required to maintain the first web of sheet material 84 centered through the sheet material delivery assembly 72. Likewise, the second arbor 86 is mounted on a slide base 106. To automatically adjust the slide bases 104, 106, a web guide is operably connected to each of the slide bases 104, 106. Electronic web guides are commercially available and typically include a web edge sensor 110 which is mounted on one side of the web on a threaded shaft, such as the threaded shaft 111, so that an operator can rotate a hand wheel (not shown) to position the web edge sensor 110 to provide the desired web width. The web edge sensor 110 is electrically connected to a motor (not shown) which drives a threaded shaft 112, on which the slide bases 104 and 106 are mounted, respectively.

The sheet material delivery assembly 72 further includes a series of rollers mounted between a first frame member 113*a* and a second frame member 113*b* to maintain a ready supply of sheet material for the cutting and transfer assembly 74. The series of rollers includes a first idler roller 114*a*, a second idler roller 116*a*, the dancer roller 100*a*, a third idler roller 118*a*, a fourth idler roller 119*a*, a fifth idler roller 120*a*, a sixth idler roller 121*a*, a seventh idler roller 122*a*, a pull roller 124*a*, a second dancer roller 126*a*, and an eighth idler roller 128*a*. The second web of sheet material 90 is threaded over a substantially similar set of rollers 114*b*, 116*b*, 100*b*, 118*b*, 120*b*, 122*b*, 124*b*, 126*b*, and 128*b*.

A retractable walk way 130 is provided so that an operator can have easy access to the arbor 80 for installing a new roll of sheet material.

Each of the pull rollers 124*a* and 124*b* are driven by a motor 132. A suitable motor is a one-half horsepower variable speed electric motor controlled by AC frequency invertor and electronic motorized potentiometer. The motors 132 are driven at an average web speed so that the rolls of sheet material and dancer system run at a constant payout speed.

A pair of edge trimmers (not shown) can be mounted on a rotating cross bar to cut the web of sheet material to a desired width. The edge trimmers are manually adjustable to allow an operator to adjust the web width. The trim scrap is removed by a commercially available trim removal system (not shown).

The second dancer rollers 126*a* and 126*b* serve as storage rollers. To this end, the second dancer rollers 126*a* and 126*b* are mounted on a rack and pinion gearing system to allow the second dancer rollers 126*a*, 126*b* to move vertically a distance of about 25 inches, thereby providing a storage length of about 50 inches. A vertical roll travel sensor (not shown) is positioned at both the top and bottom travel limits of the second dancer roller. The sensor is electrically connected to the motors 132 and generate a signal for adjusting the speed of the pull rollers 124*a* and 124*b* so that when the second dancer rollers 126*a* and 126*b* are at the bottom travel limit the speed of the pull rollers 124*a* and 124*b* is slowed and when the second dancer rollers 126*a* and 126*b* are at the top travel limit the speed of the pull rollers 124*a* and 124*b* is increased.

The cutting and transfer assembly 74 includes a first web guide 134, a second web guide 136, a first pair of nip rollers 138, a second pair of nip rollers 140, a first knife assembly 142, a second knife assembly 144, a convergence web guide 146, and a conveyor assembly 148. The nip rollers 138 pull the first web of sheet material 84 from the storage area and move the first web of sheet material 84 into position for cutting. Similarly, the nip rollers 140 pull the second web of sheet material 90 from the storage area and move the second web of sheet material 90 into position for cutting. The nip rollers 138 are powered by a servo motor 150 and the nip rollers 140 are powered by a servo motor 152. The servo motors 150 and 152 drive the rollers so that the rollers smoothly accelerate and decelerate for maximum speed while also measuring the web length and stopping the webs of sheet material 84 and 90 for cutting.

The webs of sheet material 84 and 90 are guided through the nip rollers 138, 140 and across the knife assemblies 142, 144 by the web guides 134 and 136, respectively. Each of the web guides 134 and 136 is formed from a pair of guide members 153 and a plurality of spaced apart tubes 154 provided with air nozzles 156 in the downstream end of the web guides 134, 136. The air nozzles 156 permit air to be blown across the top and bottom of the webs of sheet material to maintain the webs of sheet material in a flattened condition as the webs of sheet material are passed through the web guides 134, 136.

The knife assemblies 142, 144 cut the webs of sheet material to form a first sheet of material and a second sheet of material with each sheet of material being of a preselected length. The knife assemblies 142 and 144 are commercially available guillotine style knives which are driven by pneumatic cylinders 162*a*, 162*b* and pneumatic cylinders 164*a*, 164*b*, respectively.

Figure 8:
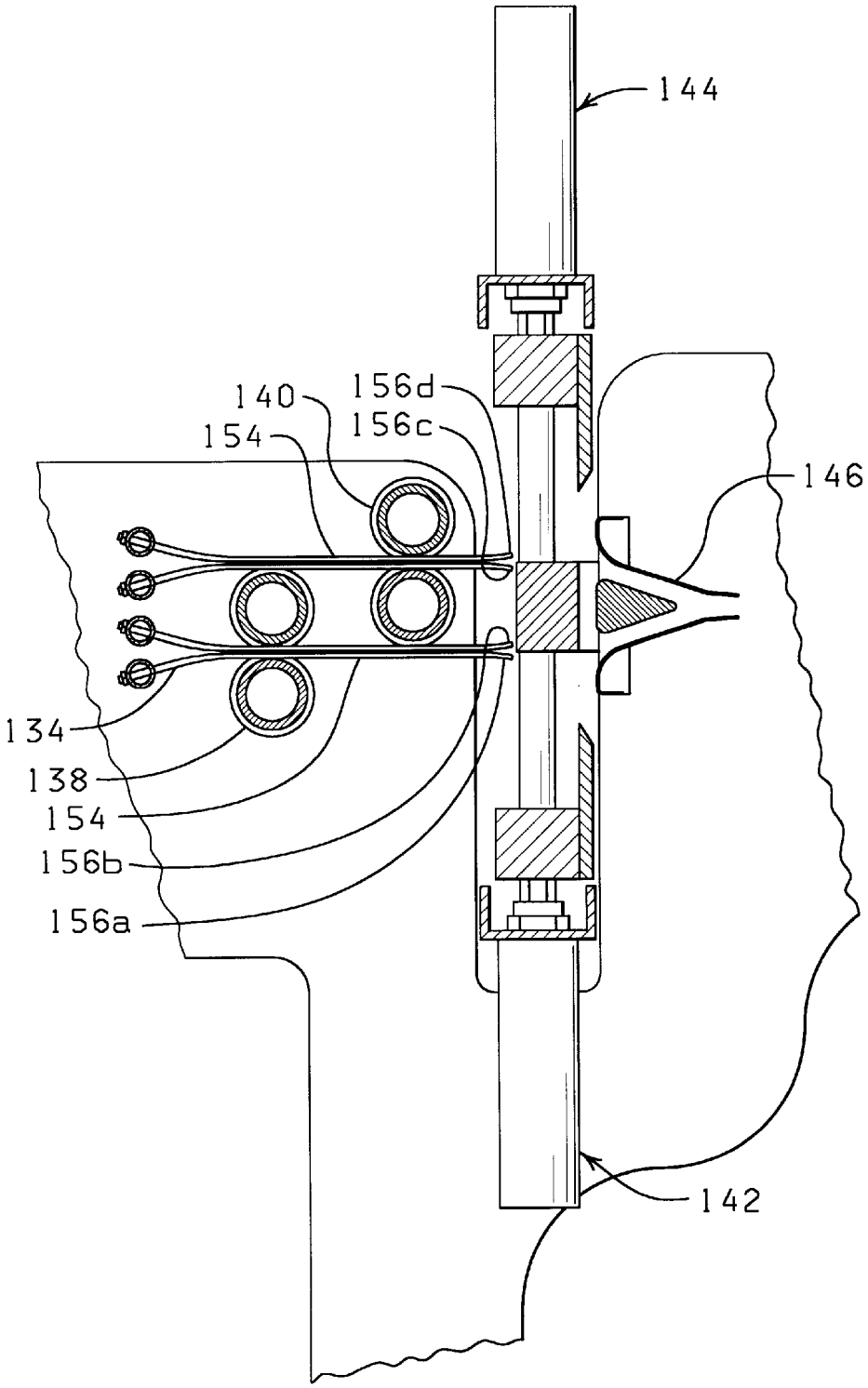
FIG. 8 is a cross section taken at line 8—8 in FIG. 7.
Figure 5:
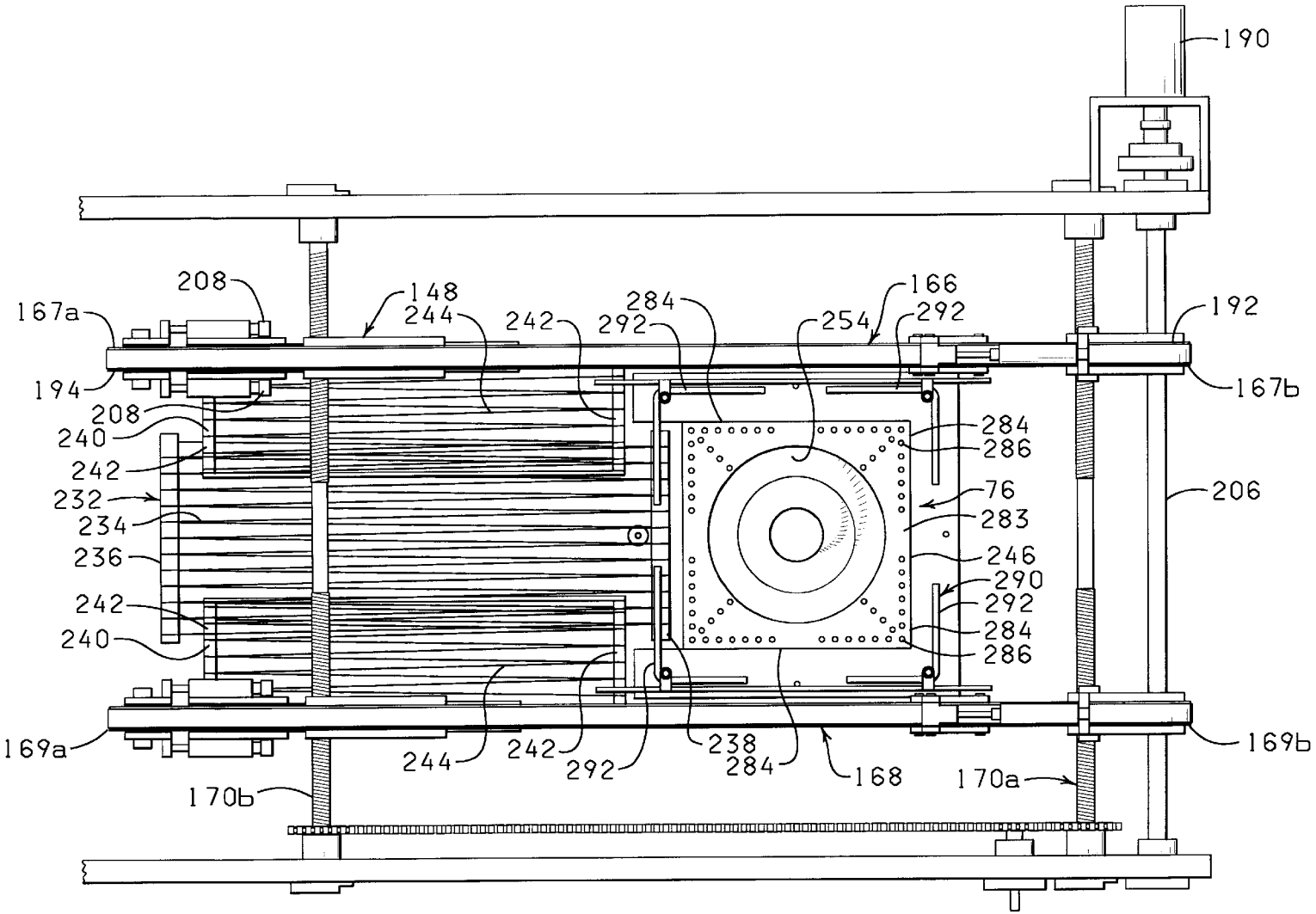

As best shown in FIG. 8, the convergence guide 146 is positioned after the knife assemblies 142 and 144 for positioning the first web of sheet material 84 on the second web of sheet material 90 and guiding the first and second webs of sheet of material 84 and 90 between the conveyor belt assembly 148 which serves to transfer the formed sheets of material to the molding assembly 76.

Figure 10:
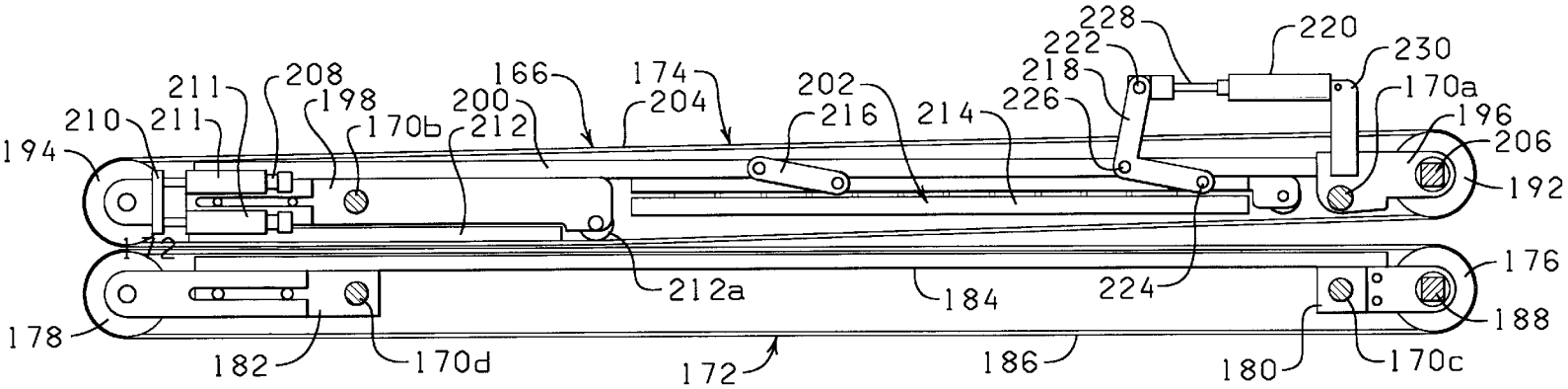
FIG. 10 is a side elevational view of a portion of the conveyor assembly in a sheet release position.
Figure 11:
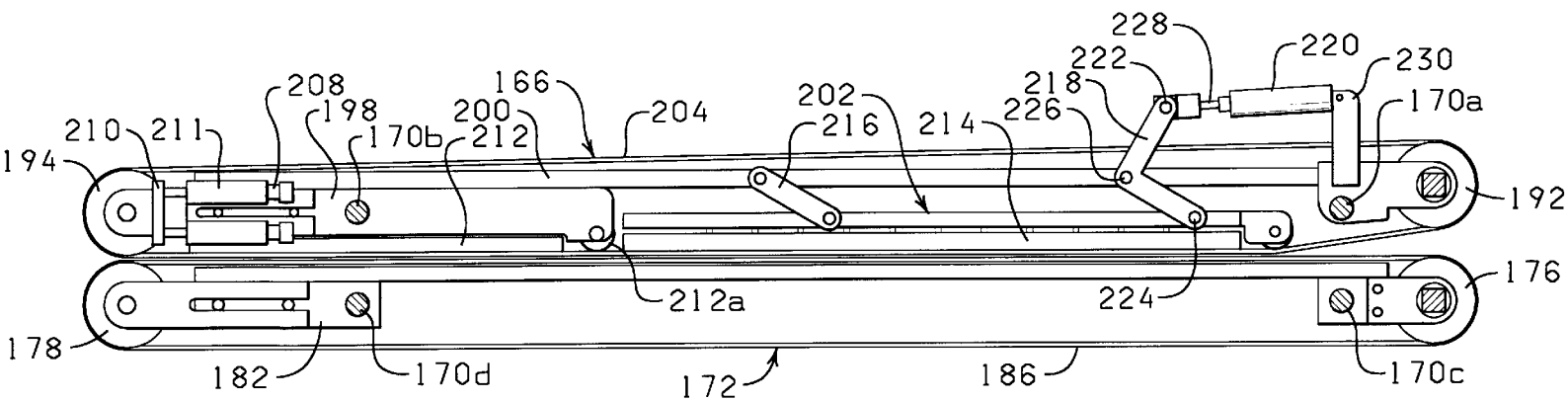
FIG. 11 is a side elevational view of a portion of the conveyor assembly in a sheet engaging position.

Referring now to FIGS. 9–11, the conveyor assembly 148 is adapted to cooperate with the nip rollers 138 and 140 to advance the webs of sheet material 84, 90 into position for cutting and to transfer the formed sheets of material to the molding assembly 76. The conveyor assembly 148 is positioned to receive the webs of sheet material 84 and 90 as the webs of sheet material 84 and 90 pass through the knife assemblies 142 and 144. The conveyor assembly 148 extends past the molding assembly 76 to enable proper positioning of the formed sheets of material relative to the molding assembly 76.

As illustrated in FIG. 9, the conveyor assembly 148 includes a first conveyor assembly 166 and a second conveyor assembly 168 positioned parallel to one another. The first conveyor assembly 166 is characterized as having a sheet receiving end 167*a* positioned proximate the knife assemblies 142 and 144 and a sheet discharge end 167*b* positioned adjacent one side of the molding assembly 76. Similarly, the second conveyor assembly 168 is characterized as having a sheet receiving end 169*a* positioned proximate the knife assemblies 142 and 144 and a sheet discharge end 169*b* positioned adjacent an opposing side of the molding assembly 76. The first and second conveyor assemblies 166, 168 are supported by a plurality of threaded cross rods 170*a*–170*d* (FIGS. 9, 10 and 11). The threaded cross rods 170*a*–170*d* are provided with right hand and left hand threads to permit the distance which the first and second conveyor assemblies 166, 168 are spaced apart to be adjusted to accommodate sheets of material having various widths. The first and second conveyor assemblies 166, 168 are identical in construction. Thus, only the first conveyor assembly 166 will be described in detail hereinafter.

As best shown in FIGS. 10 and 11, the first conveyor assembly 166 includes a first or lower conveyor assembly 172 and a second or upper conveyor assembly 174. The lower conveyor assembly 172 includes a drive pulley 176, an idler pulley 178, a first carriage 180, a second carriage 182, a belt support rail 184, and a belt 186. The first and second carriages 180 and 182 are threadingly mounted on the threaded cross rods 170*c* and 170*d*, respectively. The drive pulley 176 is in turn secured to the first carriage 180 and slidingly secured on a square axle 188 which in turn is connected to a servo motor 190 (FIG. 9). The idler pulley 178 is secured to the second carriage 182. The belt support rail 184 has one end secured to the first carriage 180 and the other end secured to the second carriage 182 such that the belt support rail 184 substantially extends from the idler pulley 178 to the drive pulley 176. The belt 186 is disposed about the drive pulley 176 and the idler pulley 178 with the upper portion of the belt being supported on the belt support rail 184.

The upper conveyor assembly 174 includes a drive pulley 192, an idler pulley 194, a first carriage 196, a second carriage 198, a belt support rail 200, a releasable holddown rail assembly 202, and a belt 204. The first carriage 196 is threadingly mounted on the threaded cross rod 170*a*. The drive pulley 192 is in turn secured to the first carriage 196 and slidingly secured on a square axle 206 which in turn is interconnected to the servo motor 190 (FIG. 9). The second carriage 198 is threadingly mounted on the threaded cross rod 170*b*. The idler pulley 194 is resiliently connected to the second carriage 198 to allow the idler pulley 194 to move in a to and fro direction relative to the second carriage 198 to account for changes in the tension of the belt 204. More specifically, the idler pulley 194 is connected to the second carriage 198 with a plurality of spring loaded bolts 208 having one end secured to a bracket 210 interconnected to the idler pulley 194 and a second end slidingly disposed in a cylinder 211 mounted to the second carriage 198. The second end of the bolt 208 is engaged by a spring (not shown) disposed in the cylinder 211 such that the spring causes the bolt 208 to be biased in an extended position.

The belt support rail 200 extends across the top of the first and second carriages 196, 198 such that the belt support rail 200 has one end secured to the first carriage 196 and the other end secured to the second carriage 198 and such that the belt support rail 200 substantially extends from the idler pulley 194 to the drive pulley 192. The second carriage 198 is provided with a spring loaded belt holddown rail 212 and a roller 212*a* positioned along the lower end thereof for maintaining the belt 204 in a sheet gripping relationship with the belt 186. The belt holddown rail 212 is preferably fabricated of a low friction material, such as nylon. The belt 204 is disposed about the drive pulley 192 and the idler pulley 194 with the upper portion of the belt 204 being supported by the belt support rail 200.

The releasable holddown rail assembly 202 is adapted to hold down the portion of the belt 204 positioned adjacent the molding assembly 76 when transferring a sheet or sheets of material to the molding assembly 76 and to release the portion of the belt 204 positioned adjacent the molding assembly 76 during the molding process so as to prevent the sheet or sheets of material from being torn or otherwise damaged. The releasable holddown rail assembly 202 includes a holddown rail 214, a pair of link members 216 (only one visible in FIGS. 10 and 11), a pair L-shaped link members 218 (only one visible in FIGS. 10 and 11), and a pneumatic cylinder 220.

The holddown rail 214 is positioned between the first and second carriages 196 and 198 and below the belt support rail 200. The holddown rail 214 is dimensioned so that the holddown rail 214 is movable between a sheet engaging position (FIG. 11) wherein the holddown rail 214 engages the belt 204 to cause the belt 204 to cooperate with the belt 186 of the lower conveyor assembly 172 to grip or clamp a portion of a sheet of material and a release position (FIG. 10) wherein the holddown rail 214 is raised toward the belt support rail 200 so as to cause the portion of the belt 204 adjacent to the holddown rail 214 to raise up in a nongripping position relative to the belt 204 and thus release the sheet of material. It will be understood that the tension of the belt 204 is increased when the holddown rail 214 is lowered to the sheet engaging position thus causing the idler pulley 194 to be pulled inwardly toward the second carriage 198.

The holddown rail 214 is connected to the belt support rail 200 with the link members 216 and the L-shaped link members 218 as substantially shown in FIGS. 10 and 11. That is, each link member 216 has a first end pivotally connected to one side of the belt support rail 200 and an opposing second end pivotally connected to the adjacent side of the holddown rail 214. The link members 216 are angularly disposed relative to the belt support rail 200 and the holddown rail 214.

The L-shaped link members 218 are each characterized as having a first end 222, a second end 224, and a medial portion 226. The medial portion 226 of each of the L-shaped link members 218 is pivotally connected to one side of the belt support rail 200 and the second end 224 of each of the L-shaped link members 218 is pivotally connected to the adjacent side of the holddown rail 214. The first end 222 of the L-shaped link members 218 is pivotally connected to the end of a rod 228 of the cylinder 220. The opposite end of the cylinder 220 is pivotally secured to a pair of brackets 230 extending upward from the first carriage 196.

The cylinder 220 is movable between a retracted position (FIG. 11) and an extended position (FIG. 10). When the cylinder 220 is retracted, the L-shaped link members 218 cause the holddown rail 214 to lower to the sheet engaging position. Conversely, when the cylinder 220 is extended, the L-shaped link members 218 cause the holddown rail 214 to rise to the release position.

A sheet support assembly 232 (FIG. 9) is provided to support the sheet or sheets of material between the first and second conveyor assemblies 166, 168. The sheet support assembly 232 includes a wire 234 looped several times about a rod 236 positioned proximate the convergence guide 146 and a rod 238 positioned proximate the molding assembly 76 to form a platform for supporting a sheet of material. The wire 234 is preferably fabricated of a low friction material, such as nylon, to not only reduce friction, but also dissipate the generation of static electricity in the sheet or sheets of material as the sheets of material pass across the sheet support assembly 232. The sheet support assembly 232 further includes a pair of sheet support extensions 240 connected to the lower conveyor assembly 172 of each of the first and second conveyor assemblies 166, 168. Each of the sheet support extensions 172 includes a pair of rods 242 extending inwardly from the belt support rail 184 and a wire 244 extended between the rods 242. The sheet support extensions 240 serve to allow the width of the sheet support assembly 232 to be varied as the conveyor assembly 148 is adjusted.

Figure 12:
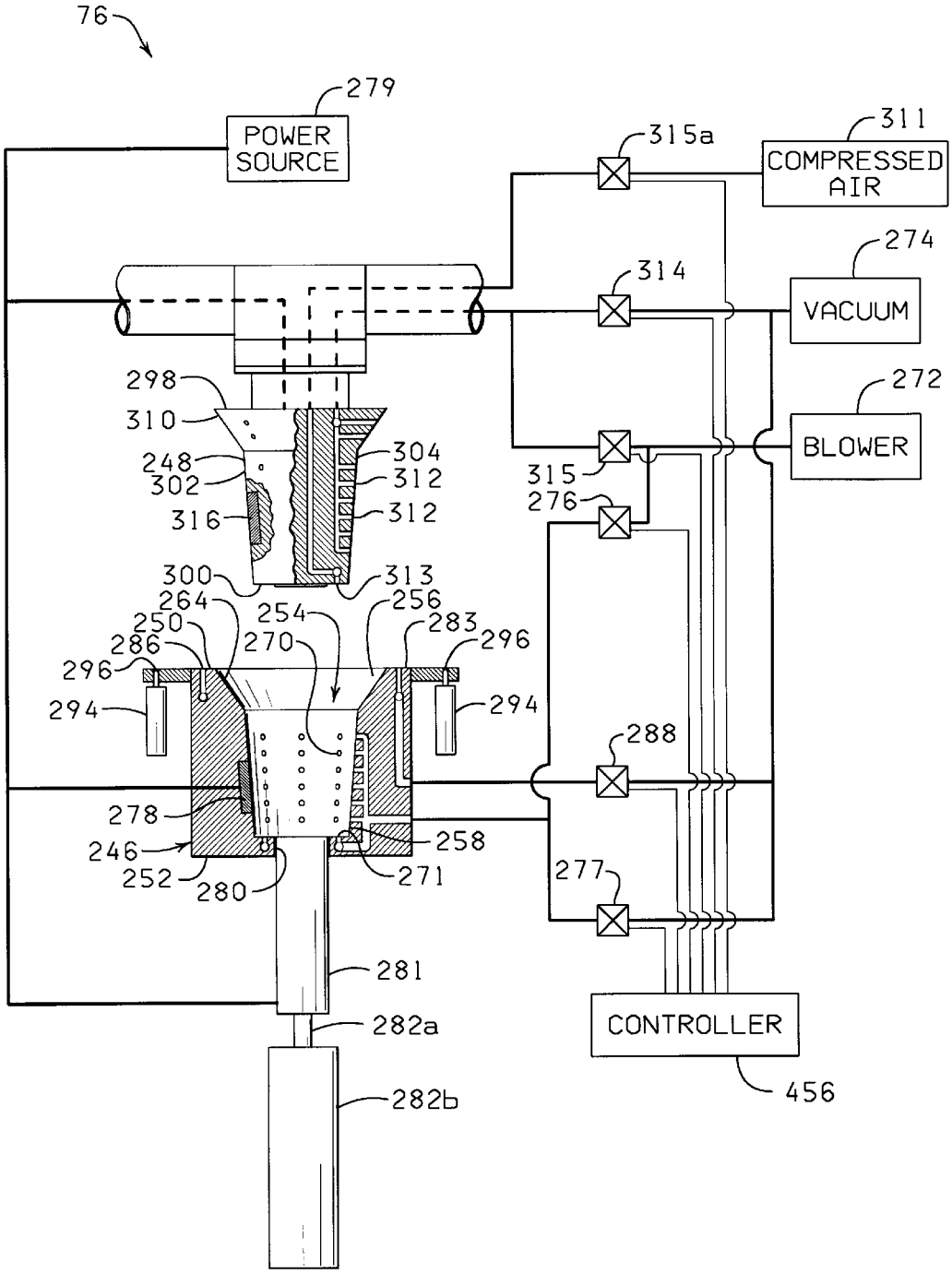
FIG. 12 is a partial schematic and cross sectional representation of the molding assembly of the article forming apparatus illustrating the male die in an up position relative to the female die.
Figure 13:
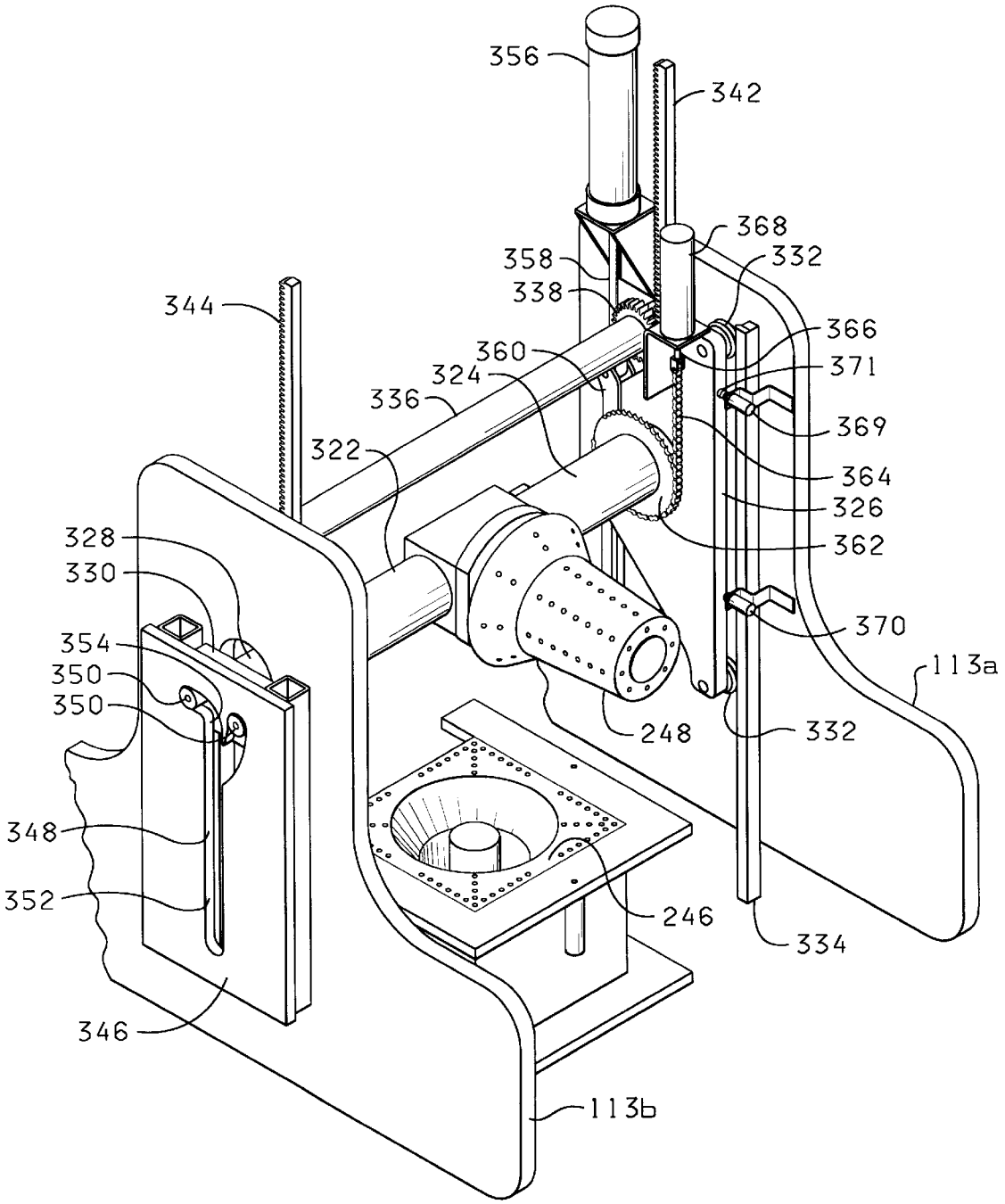
FIG. 13 is a perspective view of the molding assembly illustrating the male die in a discharge position.
Figure 14:
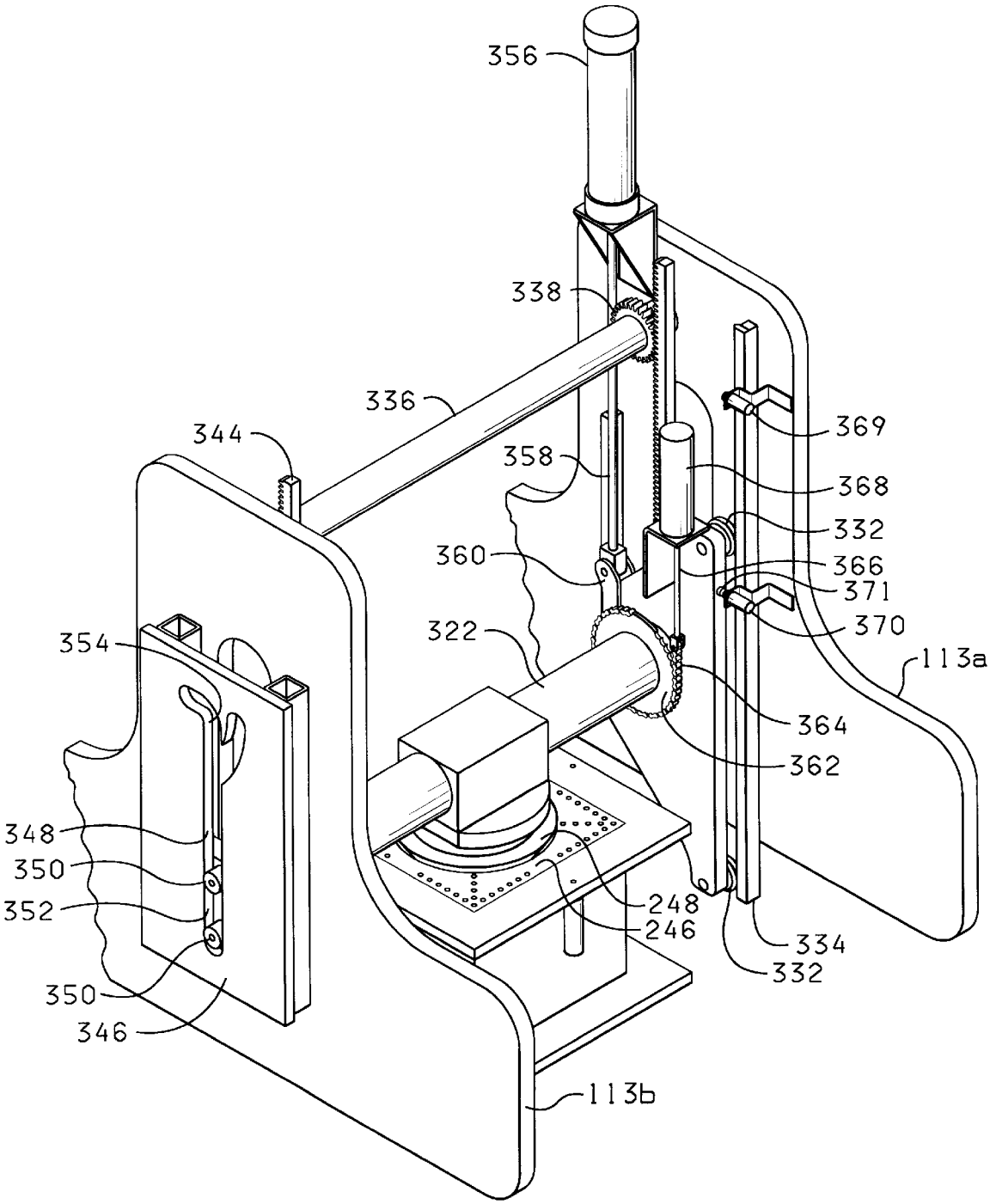
FIG. 14 is a perspective view of the molding assembly illustrating the male die in a forming position.

Referring now to FIGS. 12–14, the molding assembly 76 includes a female die 246 and a male die 248 which cooperate to form one or more sheets of material into an article, such as the flower pot cover 10 or the flower pot cover 40. The female die 246 is characterized as having an upper end 250, a lower end 252, and an opening 254 formed through the upper end 250 of the female die 246 extending a distance generally toward the lower end 252 of the female die 246. The opening 254 is defined by a female die surface 256.

The female die surface 256 includes a base portion 258 having an upper end and a lower end. The base portion 258 generally is frusto-conically shaped, thus the diameter of the base portion 258 generally near the lower end thereof is smaller than the diameter of the base portion 258 generally near the upper end thereof.

The female die surface 256 also includes a flared portion 264 having an upper end and a lower end. The flared portion 264 extends angularly outwardly and upwardly from the upper end of the base portion 258.

The female die 246 is provided with a plurality of openings 270 formed in the female die surface 256 and a plurality of openings 271 formed in the lower end 252 of the female die 246. The openings 270 and 271 are connected to a blower 272 and a vacuum source 274 such that fluid communication is established between the openings 270 and 271 and the blower 272 and the vacuum source 274. A control valve 276 is interposed between the blower 272 and the openings 270 and 271 and a control valve 277 is interposed between the vacuum source 274 and the openings 270 and 271. In one position of the control valve 276, communication is established between the blower 272 and the openings 270 and 271 in the female die 246, and in one position of the control valve 277, communication is established between the vacuum source 274 and the openings 270 and 271 in the female die 246.

A plurality of cartridge-type heating elements 278 (only one element 278 being shown in FIG. 12) are disposed in the female die 246. The heating elements 278 are positioned about the female die surface 256 and connected to an electrical power source 279 for heating the female die surface 256 to a predetermined temperature during the forming of the flower pot cover 10 or the flower pot cover 40. A temperature sensing device (not shown) is connected to the female die 246 to sense the temperature level of the female die surface 256. The sensing device controls the connection of the electrical power source 279 to the heating elements 278 to maintain the temperature level of the female die surface 256 at a desired predetermined temperature level.

The female die 246 is further provided with a central opening 280 formed in the lower end 252 thereof. An ejector member 281 is slidingly positioned in the central opening 280. The ejector member 281 is secured to one end of a rod 282*a*. The other end of the rod 282*a* is reciprocatingly disposed in a cylinder 282*b*. The rod 282*a* is movable from a down position wherein the top surface of the ejector member 281 is substantially flush with the lower end of the base portion 258 of the female die 246 and an extended position wherein the ejector member 281 is moved upward so as to eject the male die 248 from the female die 246 in a manner described in greater detail hereinbelow. The top surface of the ejector member 281 can be embossed so as to stamp the flower pot cover 10 or 40 with a desired design or product information. The ejector member 281 is provided with a cartridge-type heating element (not shown) which is similar to the heating elements 278 positioned about the female die surface 256. The heating element is positioned in the ejector member 281 and connected to the electrical power source 279 for heating the ejector member 281 to a predetermined temperature during the forming of the flower pot cover 10 or the flower pot cover 40.

As best shown in FIG. 9, the female die 246 is provided with a horizontal support surface 283 which circumscribes the opening 254 of the female die 246. The support surface 283 includes four circumferentially spaced material holddown areas 284. Each material holddown area 284 is provided with a plurality of openings 286 (only two of the openings 286 being designated by reference numerals in FIG. 9) generally arranged to form a triangular configuration and which are in communication with the vacuum source 274. A control valve 288 (FIG. 12) is interposed between the openings 286 and the vacuum source 274; the vacuum source 274 being in communication with the openings 286 in the support surface 283 in the opened position of the control valve 288. In one (opened) position of the control valve 288, communication is established between the openings 286 and the vacuum source 274 and, in one other (closed) position of the control valve 288, communication is interrupted between the openings 286 and the vacuum source 274.

The molding assembly 76 further includes a pleat control assembly 290 (shown only in FIG. 9) mounted above the support surface 283 of the female die 246 generally along the outer periphery thereof. The pleat control assembly 290 is configured to engage predetermined portions of the sheet or sheets of material disposed on the support surface 283 and thus form pleats or folds in the sheet of material in predetermined portions thereof.

The pleat control assembly 290 includes four material guides 292 secured to the conveyor assembly 148 such that the material guides 292 are elevated a distance above the support surface 283 of the female die 246 and circumferentially spaced apart about the outer peripheral portion of the support surface 283. Each of the material guides 292 is a substantially L-shaped member positioned relative to the support surface 283 so that the corners of the material guides 292 are located generally above the outer corners of the support surface 283 of the female die 246. The ends of the material guides 292 are spaced apart to permit the portion of the sheet of material positioned below the space between the material guides 292 to fold upwardly during the molding process. In contrast, the material guides 292 cause the portions of the sheet of material positioned below the material guides 292 and engaging the material guides 292 to remain substantially smooth and substantially free of overlapping folds so as to form the flared petal-like portions 24 of the flower pot cover 10 or the flower pot cover 40. It will be appreciated that the material guides 292 can be arranged in various configurations depending on the desired shape of the flower pot cover.

To further influence the shape and location of the overlapping folds formed in the sheet of material during the molding process, four pneumatic cylinders 294, each having a reciprocating rod 296, are mounted beneath the support surface 283 of the female die 246. Each cylinder 294 is mounted beneath the support surface 283 so that the rod 296 of each cylinder 294 is extendable upward from the support surface 283 generally between the ends of the material guides 292. In an extended position, the rods 296 of the cylinders 294 force the sheet of material to fold at the points where the rods 296 engage the sheet of material. In a retracted position, the rods 296 of the cylinders 294 are pulled below the support surface 283 so that another sheet of material is able to be moved across the support surface 283 and positioned over the female die 246. The operation of the cylinders 294 will be described in greater detail below.

The male die 248 is shaped and sized to formingly mate with the female die 246 with a sufficient clearance therebetween to accommodate portions of a sheet or sheets of material during the forming of an article, such as the flower pot cover 10 or the flower pot cover 40. The male die 248 is characterized as having an upper end 298, a lower end 300, and a male die surface 302. The male die surface 302 extends a distance generally from the lower end 300 toward the upper end 298 of the male die 248. A portion of the male die surface 302 extending from the lower end 300 a distance toward the upper end 298 of the male die 248 forms a base portion 304 of the male die surface 302. The base portion 304 of the male die surface 302 has an outer peripheral surface which is shaped about the same as the outer peripheral surface of a flower pot; the dimensions of the base portion 304 being slightly larger than the comparable dimensions of the outer peripheral surface of a flower pot so a flower pot cover formed by the article forming apparatus 70 of the present invention will fit generally about the outer peripheral surface of the flower pot when the flower pot cover is disposed about the flower pot.

The base portion 304 has an upper end and a lower end. The lower end of the base portion 304 coincides with and forms the lower end 300 of the male die 248. Thus, the base portion 304 of the male die surface 302 generally is frustoconically shaped with the diameter of the base portion 304 generally at the lower end being smaller than the diameter of the base portion 304 generally at the upper end of the base portion 304. The male die surface 302 also includes a flared portion 310 which flares a distance angularly outwardly and upwardly from the upper end of the base portion 304. The flared portion 310 of the male die surface 302 is characterized as having an upper end and a lower end with the lower end thereof being connected to the upper end of the base portion 304.

A plurality of openings 312 (only two openings 312 being designated by a reference numeral in FIG. 12) are formed through the male die 248 with each opening 312 extending through the male die surface 302, and a plurality of openings 313 are formed through the lower end 300 of the male die 248. The openings 312 are connected to the blower 272 and the vacuum source 274 such that fluid communication is established between the openings 312 and the blower 272 and the openings 312 and the vacuum source 274 while the openings 313 are connected to a compressed air source 311 such that fluid communication is established between the openings 313 and the compressed air source 311. A control valve 314 is interposed between the vacuum source 274 and the openings 312, a control valve 315 is interposed between the blower 272 and the openings 312, and a control valve 315*a* is interposed between the compressed air source 311 and the openings 313. In one position of the control valve 314, communication is established between the vacuum source 274 and the openings 312 in the male die 248, in one position of the control valve 315 communication is established between the blower 272 and the openings 312, and in one position of the control valve 315*a* communication is established between the compressed air source 311 and the openings 313 in the male die 248.

A plurality of cartridge type heating elements 316 (only one element 316 being shown in FIG. 12) are disposed in the male die 248. Each of the heating elements 316 is disposed in an inner portion of the male die 248 and the heating elements 316 are positioned about the male die 248 to heat the male die surface 302 to a predetermined temperature level during the operation of the article forming apparatus 70. Each of the heating elements 316 is connected to the electrical power source 279. A temperature sensing device (not shown) is positioned in the male die 248 and connected to the electrical power source 279 to sense the temperature level of the male die surface 302 and maintain the temperature level of the male die surface 302 at a desired predetermined temperature level.

As shown in FIGS. 13 and 14, the male die 248 is supported above the female die 246 between the first frame member 113*a* and the second frame member 113*b* such that the male die 248 is movable between a horizontal discharge position (FIG. 13) wherein the male die 248 is removed from the female die 246 and rotated through an angle of approximately 90 degrees whereby a formed article, such as the flower pot cover 10 or 40, is removable from the male die 248 and a vertical forming position (FIG. 14) wherein the male die 248 is matingly disposed into the female die 246. The male die 248 is fixed to a support shaft 322 having a first end 324 rotatably mounted to a first carriage 326 and an opposing second end 328 rotatably mounted to a second carriage 330. Each of the first and second carriages 326, 330 is provided with a plurality of V-shaped rollers 332 which are rollingly disposed in a set of V-shaped tracks 334 vertically mounted on the inside of each of the first frame member 113*a* and the second frame member 113*b* to permit vertical movement of the first and second carriages 326, 330 along the V-shaped tracks 334.

An axle 336 having a first geared end 338 and a second geared end (not visible) is rotatingly mounted between the first and second frame members 113*a*, 113*b*. To further stabilize the first and second carriages 326, 330, the first geared end 338 of the axle 336 matingly engages a gear track 342 extending from the first carriage 326, and the second geared end of the axle 336 matingly engages a gear track 344 extending from the second carriage 330.

To control the rotational position of the support shaft 322 and thus the male die 248, a cam plate 346 having a guide slot 348 formed therein is shown mounted to the second frame member 320. The second end 328 of the support shaft 322 is provided with a pair of rollers 350 which are adapted to travel in the guide slot 348. The guide slot 348 has a straight vertical portion 352 and a Y-shaped portion 354. The straight vertical portion 352 of the guide slot 348 cooperates with the rollers 350 of the support shaft 322 to hold the support shaft 322 in a position where the male die 248 is aligned with the female die 246 (FIG. 14). The Y-shaped portion 354 of the guide slot 348 is configured such that when the support shaft 322 is lifted upward where the rollers 350 are influenced by the Y-shaped portion 354 of the guide slot 348, the support shaft 322 is caused to rotate 90 degrees as shown in FIG. 13.

To assist in moving the support shaft 322 in an up and down direction, a pneumatic cylinder 356 having a reciprocating rod 358 is connected to the inside of the first frame member 318. The end of the rod 358 of the cylinder 356 is in turn connected to the first carriage 326 via a bracket 360. As will be explained in further detail below, the cylinder 356 cooperates with the cylinder 282*b* to move the support shaft 322, and thus the male die 248, in an up and down direction along the V-shaped tracks 334.

The support shaft 322 is provided with a sprocket 362 near the first end 324 of the support shaft 322. The sprocket 362 is fixed to the support shaft 322 and adapted to receive a chain 364. The chain 364 is looped around the sprocket 362 with one end of the chain 364 being fixed to a portion of the sprocket 362 and the other end of the chain 364 being attached to the end of a rod 366 of a pneumatic cylinder 368. The cylinder 368 is mounted to a portion of the first carriage 326 whereby the cylinder 368 is supported by the first carriage 326. The cylinder 368 is allowed to retract when the rollers 350 of the support shaft 322 enter the Y-shaped portion 354 of the guide slot 348 and cause the cylinder 368 to pull the chain 364 and cause the support shaft 322 to rotate to the horizontal or discharge position.

In order to signal when the male die 248 is in the discharge position or the extended position, an upper proximity switch 369 and a lower proximity switch 370 are connected to the first frame member 318 in a vertically spaced apart relationship adjacent to the first carriage 326. A plate member 371 is provided on the first carriage 326 such that the plate member 371 trips the upper proximity switch 369 when the male die 248 is in the discharge position (FIG. 13) and the plate member 371 trips the lower proximity switch 370 when the male die 248 is in the forming position (FIG. 14).

It will be appreciated that a pneumatic labeling mechanism (not shown) can be incorporated with the molding assembly 76 whereby a decorative or informational label is affixed to the formed flower pot cover upon the male die 248 reaching the discharge position.

Figure 15A:
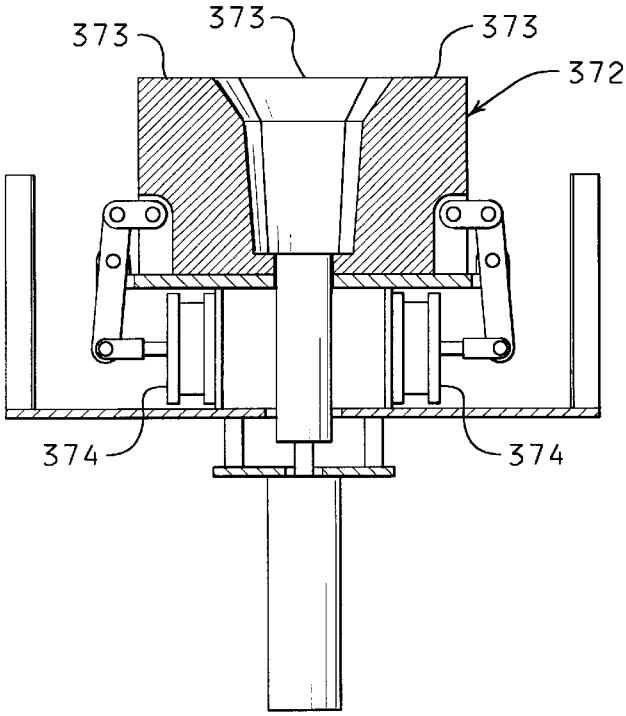
FIG. 15A is a partial cross sectional, elevational view of another embodiment of a female die constructed in accordance with the present invention illustrating the female die in a closed position.
Figure 15B:
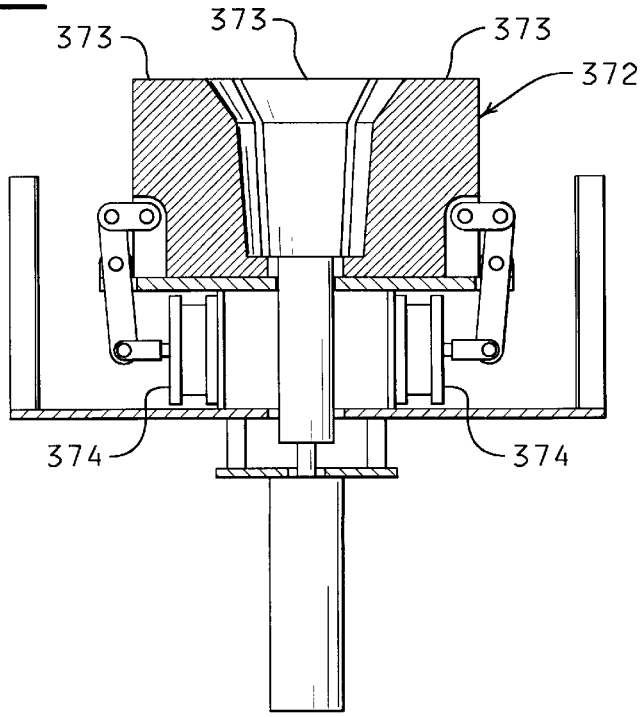
FIG. 15B is a partial cross sectional, elevational view of the female die of FIG. 15A illustrated in an open position.

FIGS. 15A and 15B show another embodiment of a female die 372. The female die 372 is configured from four die segments 373 which are moveable between an open position (FIG. 15B) wherein the four die segments 373 of the female die 372 are spread apart, and a closed position (FIG. 15A) wherein the four die segments 373 are brought together to increase the pressure exerted on the sheet of material positioned between the male die 248 and the female die 372, and in turn, bond the overlapping folds created in the sheet of material more quickly in order to decrease the length of time the male die 248 needs to be disposed in the female die 372. The lower end of each female die segment 373 is pivotally linked to a pancake-type cylinder 374. Extension of the cylinders 374 causes the female die segments 373 to move to the close position and retraction of the cylinders 374 causes the female die segments 373 to move to the open position.

Referring now to FIGS. 5, 6, and 16A–16C, the stacking assembly 78 is adapted to remove the formed flower pot covers from the male die 248 with the male die 248 in the discharge position, form a stack of flower pot covers, and transfer the stack of flower pot covers to a conveyor belt (not shown). As shown in FIG. 6, the stacking assembly 78 includes a transfer cup support frame 378 for supporting a transfer cup 380 and a stacking shell support frame 382 for supporting a pair of stacking shells 384*a* and 384*b*.

The transfer cup support frame 378 has a base portion 386 and a transfer cup support portion 388 supported a distance above the base portion 386. The transfer cup support portion 388 is adapted for supporting the transfer cup 380 so that the transfer cup 380 is movable between a horizontal position (FIG. 16A) and a vertical position (FIG. 16B) and is movable between a retracted position and an extended position in each of the horizontal position and the vertical position as represented by arrow 387. Both FIG. 16A and FIG. 16B show the transfer cup in the extended position.

Figure 16A:
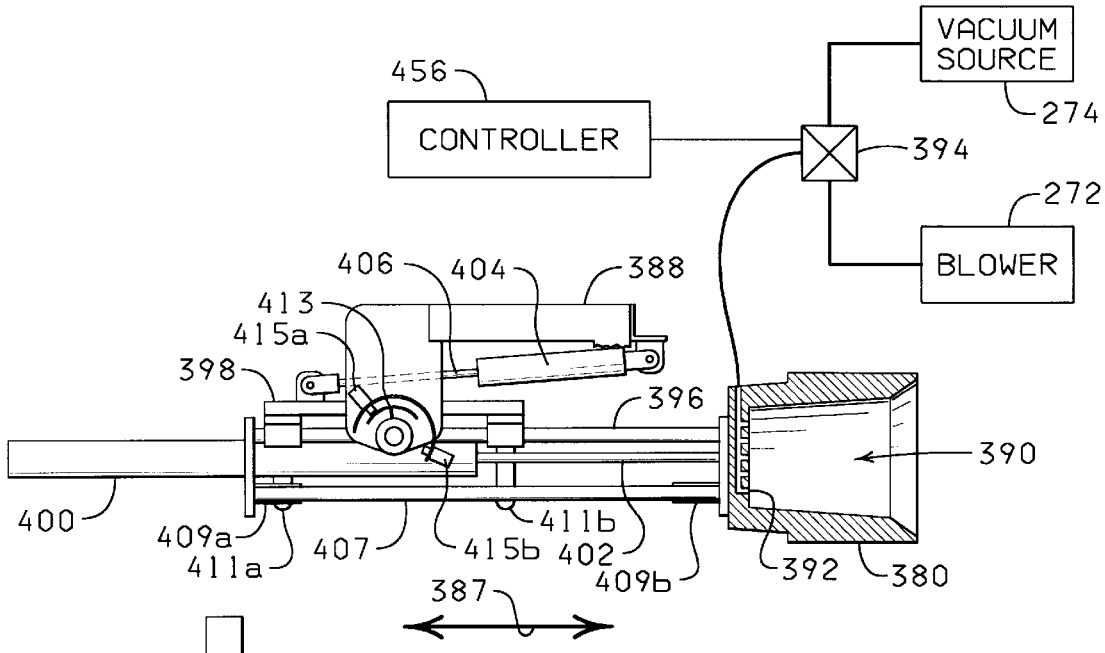
FIG. 16A is a partial cross sectional, partial schematic, elevational view of the stacking assembly illustrating the transfer cup in a retracted horizontal position.
Figure 16B:
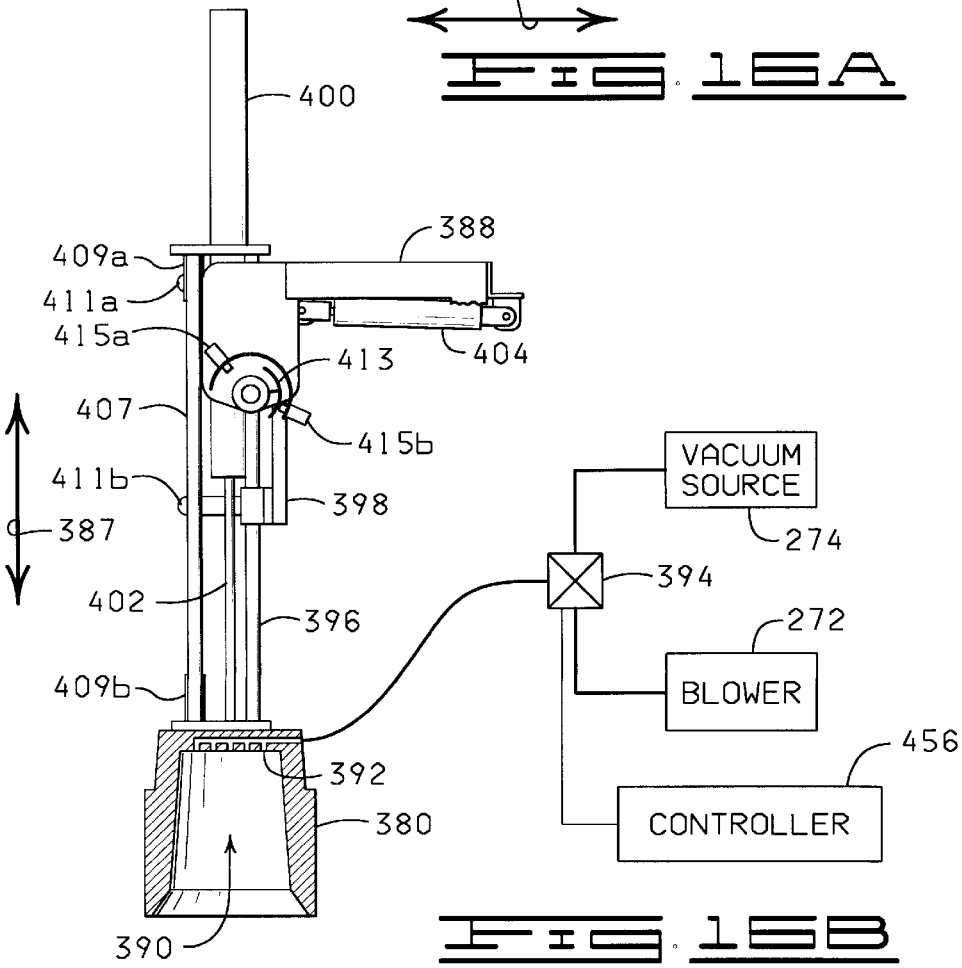
FIG. 16B is a partial cross sectional, partial schematic, elevational view of the stacking assembly of FIG. 16A illustrating the transfer cup in a retracted vertical position.

Referring more specifically to FIGS. 16A and 16B, the transfer cup 380 has an article receiving space 390 which is sized and shaped to receive the base portion 304 of the male die 248 when a flower pot cover is disposed on the male die 248. The transfer cup 380 is also provided with a plurality of openings 392 in the bottom thereof. The openings 392 are connected to the vacuum source 274 and the blower 272 such that fluid communication is established between the article receiving space 390 and the vacuum source 274 and the blower 272. A control valve 394 is interposed between the vacuum source 274 and the blower 272. In one position of the control valve 394, communication is established between the vacuum source 274 and the article receiving space 390 of the transfer cup 380, and in another position of the control valve 394, communication is established between the blower 272 and the article receiving space 390 of the transfer cup 380.

The transfer cup 380 is connected to a pair of parallel support rods 396 extending from the back side of the transfer cup 380 (only one support rod 396 being visible in FIGS. 16A and 16B). The support rods 396 are slidingly supported on a support plate 398 pivotally mounted to the transfer cup support portion 388 of the transfer cup support frame 378. To effect movement of the transfer cup 380 between the retracted position and the extended position, the transfer cup 380 is also connected to a pneumatic cylinder 400 having a reciprocating rod 402 with the end of the rod 402 being connected to the back side of the transfer cup 380. The transfer cup 380 is rotated between the horizontal position and the vertical position with a pneumatic cylinder 404 having a reciprocating rod 406. The end of the rod 406 of the cylinder 404 is pivotally interconnected to a portion of the support plate 398 such that the transfer cup 380 is positioned in the horizontal position when the cylinder 404 is extended and in the vertical position when the cylinder 404 is retracted.

To signal whether the transfer cup 380 is in the extended position or the retracted position, a rod 407 extending from the back of the transfer cup 380 is provided with a pair of plate members 409*a* and 409*b*. The plate member 409*a* triggers a first proximity switch 411*a* when the transfer cup 380 is in the extended position and the plate member 409*b* triggers a second proximity switch 411*b* when the transfer cup 380 is in the retracted position. To signal whether the transfer cup 380 is in the horizontal position or the vertical position, a plate member 413 is rotatable between a third proximity switch 415*a* and a fourth proximity switch 415*b*. The plate member 413 is caused to trip the third proximity switch 415*a* when the transfer cup 380 is in the horizontal position and the plate member 413 is caused to trip the fourth proximity switch 415*b* when the transfer cup 380 is in the vertical position.

The transfer cup 380 is mounted to the transfer cup support portion 388 so that the transfer cup 380 is in alignment with the male die 248 when the transfer cup 380 is in the horizontal position and the male die 248 is in the horizontal discharge position, as substantially shown in FIG. 5. With the male die 248 in the horizontal discharge position and with a formed flower pot cover disposed thereon, the transfer cup 380 is extended by the cylinder 400 so that the transfer cup 380 is disposed about the flower pot cover and the male die 248. With the transfer cup 380 extended, the vacuum on the male die 248 is terminated and the blower is activated, and the vacuum in the transfer cup 380 is activated whereby the flower pot cover is transferred to the transfer cup 380. The cylinder 400 then retracts the transfer cup 380 with the flower pot cover disposed in the transfer cup 380. With the transfer cup 380 retracted, the cylinder 404 is retracted thereby rotating the transfer cup 380 to the vertical position where the transfer cup 380 is positioned to dispose the flower pot cover held by the transfer cup 380 onto one of the stacking shells 384*a*, 384*b* of the stacking shell support frame 382.

As best illustrated in FIG. 16C, the stacking shell support frame 382 has a base portion 408 and three spaced apart stacking shell support assemblies 410 extending upward from the base portion 408. The stacking shell support assemblies 410 are characterized has having a forward support 412, a rearward support 414, and a top support 416. Shell carriages 418*a* and 418*b* are mounted between each adjacent pair of stacking shell support assemblies 410 on the rearward support 414 of the stacking shell support assemblies 410 such that the shell carriages 418*a* and 418*b* are independently slidable in an up and down direction along the rearward support 414 of the stacking shell support assemblies 410.

Each of the stacking shells 384*a*, 384*b* is pivotally mounted on the shell carriages 418*a*, 418*b*, respectively, so that the stacking shells 384*a*, 384*b* are pivotally movable between a stacking position wherein the stacking shells are vertically oriented to receive flower pot covers from the transfer cup 380 (as illustrated by the stacking shell 384*a* in FIG. 16C) and a dumping position wherein the stacking shells 384*a*, 384*b* are rotated or tilted downwardly to dump the stack of flower pot covers disposed on the stacking shell (as illustrated by the stacking shell 384*b* in FIG. 16C). Each of the stacking shells 384*a*, 384*b* is rotated between the stacking position and the dumping position with a pneumatic cylinder 420 having a reciprocating rod (not visible). The end of the rods of the cylinders 420 are pivotally interconnected to a portion of the bottom of the stacking shells 384*a* and 384*b*, as represented by the numeral 422, such that the stacking shells 384*a*, 384*b* are positioned in the stacking position when the cylinders 420 are extended and in the dumping position when the cylinders 420 are retracted. Each of the stacking shells 384*a*, 384*b* serves as a base for forming a stack of flower pot covers. To this end, each of the stacking shells 384*a*, 384*b* has a configuration substantially similar to the male die 248 whereby each of the stacking shells 384*a*, 384*b* is sized and shaped to receive the flower pot cover from the transfer cup 380.

The stacking shell support frame 382 is positioned on the transfer cup support frame 378 with the base portion 408 of the stacking shell support frame 382 disposed on the base portion 386 of the transfer cup support frame 378 whereby the stacking shell support frame 382 is laterally slidable over the base portion 386 of the transfer cup support frame 378. The stacking shell support frame 382 is slidable along the base portion 386 of the transfer cup support frame 378 so that the stacking shells 384*a*, 384*b* are alternatively alignable with the transfer cup 380 when the transfer cup 380 is in the vertical position whereby when one of the stacking shells 384*a*, 384*b* is being dumped, the other stacking shell 384*a* or 384*b* is in position beneath the transfer cup 380 to receive flower pot covers without interruption.

The stacking shell support frame 382 is shifted laterally by a pneumatic cylinder 424 having one end mounted to one side of the base portion 386 of the transfer cup support frame 378 and the end of a reciprocating rod 426 of the cylinder 424 connected to a portion of the base portion 408 of the stacking shell support frame 382. The cylinder 424 is movable between an extended position wherein one of the stacking shells 384*a* or 384*b* is aligned with the transfer cup 380 and a retracted position wherein the other stacking shell 384*a* or 384*b* is aligned with the transfer cup 380.

Each of the shell carriages 418*a* and 418*b* is supported by a counterweight assembly 428*a* and 428*b*, respectively, which permits the stacking shells 384*a* and 384*b* to be independently raised and lowered. Each of the counterweight assemblies 428*a* and 428*b* includes a weight member 430*a* and 430*b*, respectively, interconnected to the shell carriages 418*a* and 418*b* with a pair of chains 432*a* and 432*b*, respectively. Each of the chains 432*a* is looped over a pair of sprockets 434*a*, 434*b* mounted on the top support 416 of the stacking shell support assemblies 410 and each of the chains 432*b* is looped over a pair of sprockets 435*a*, 435*b* mounted on the top support 416 of the stacking shell support assemblies 410 with one end of the chains 432*a* and 432*b* attached to the shell carriage 418*a* or 418*b* and the other end of the chains attached to the respective weight member 430*a* or 430*b*. The sprockets 434*a* positioned near the forward support 412 of the stacking shell support assemblies 410 are fixed to a rod 438 and the sprockets 435*a* positioned near the forward support 412 of the stacking shell support assemblies 410 are fixed to a rod 439, both of which are rotatably mounted to the top support 416 of adjacent stacking shell support assemblies 410 proximate the forward support 412 thereof. Each of the weight members 430*a* and 430*b* is mounted between adjacent pairs of the stacking shell support assemblies 410 on the forward support 412 of the stacking shell support assemblies 410 such that each of the weight members 430*a* and 430*b* are slidable in an up and down direction along the forward support 412 of the stacking shell support assemblies 410.

When in the vertical position, the transfer cup 380 is extendable downward onto the stacking shell 384*a* or 384*b* aligned therewith. Once the transfer cup 380 is positioned on the stacking shell 384*a* or 384*b*, the vacuum in the transfer cup 380 is terminated and the blower is turned on. The transfer cup 380 is then retracted thus leaving the flower pot cover on the stacking shell 384*a* or 384*b*. The stacking shells 384*a* and 384*b* start receiving flower pot covers from the transfer cup 380 in an up position. After a predetermined number of cycles, two to three flower pot covers for example, the stacking shell 384*a* or 384*b* receiving the flower pot covers is lowered a distance to account for the accumulation of flower pot covers on the stacking shell 384*a* or 384*b*. The stacking shells 384*a* and 384*b* are usually lowered the distance represented by one chain length.

The lowering of each of the stacking shells 384*a*, 384*b* is accomplished by the use of a ratchet assembly 440*a* and a ratchet assembly 440*b*, respectively. Each of the ratchet assemblies 440*a* and 400*b* includes a pneumatic cylinder 442 with a reciprocating rod (not visible). The end of the rods are provided with a pawl 446 which is adapted to engage one of the chains 432*a* or 432*b* when the cylinder 442 is extended from a retracted position so as to move the chain 432*a* or 432*b* and thus lift the weight member 430*a* or 430*b* and lower the shell carriage 418*a* or 418*b*. The configuration of the pawl 446 is such that the pawl 446 is disengaged from the chain 432*a* or 432*b* when the cylinder 442 is retracted.

Each of the shell carriages 418*a*, 418*b* and the weight members 430 are supported by shoe brakes 448*a* and 448*b*, respectively. The shoe brakes 448*a*, 448*b* are releasable clamp-type devices disposed about one end of the rods 438, respectively. Each of the shoe brakes 448*a* and 448*b* is controlled by a pneumatic cylinder 450*a* and 450*b*, respectively, having a reciprocating rod (not visible). The rods are coupled to the shoe brakes 448*a*, 448*b* such that the shoe brakes 448*a* and 448*b* are caused to clamp the rod 438 when the cylinders 450 are retracted and the shoe brakes 448*a*, 448*b* are caused to release the rods 438 when the cylinders 450 are extended.

Control and Operation

The article forming apparatus 70 is constructed to automatically form an article, such as the flower pot cover 10 or the flower pot cover 40, from sheet material provided by the first and/or second roll of sheet material 82, 88. To this end, conventional control systems are utilized to synchronize the operation of the various components of the article forming apparatus 70 described above.

Figure 17A:
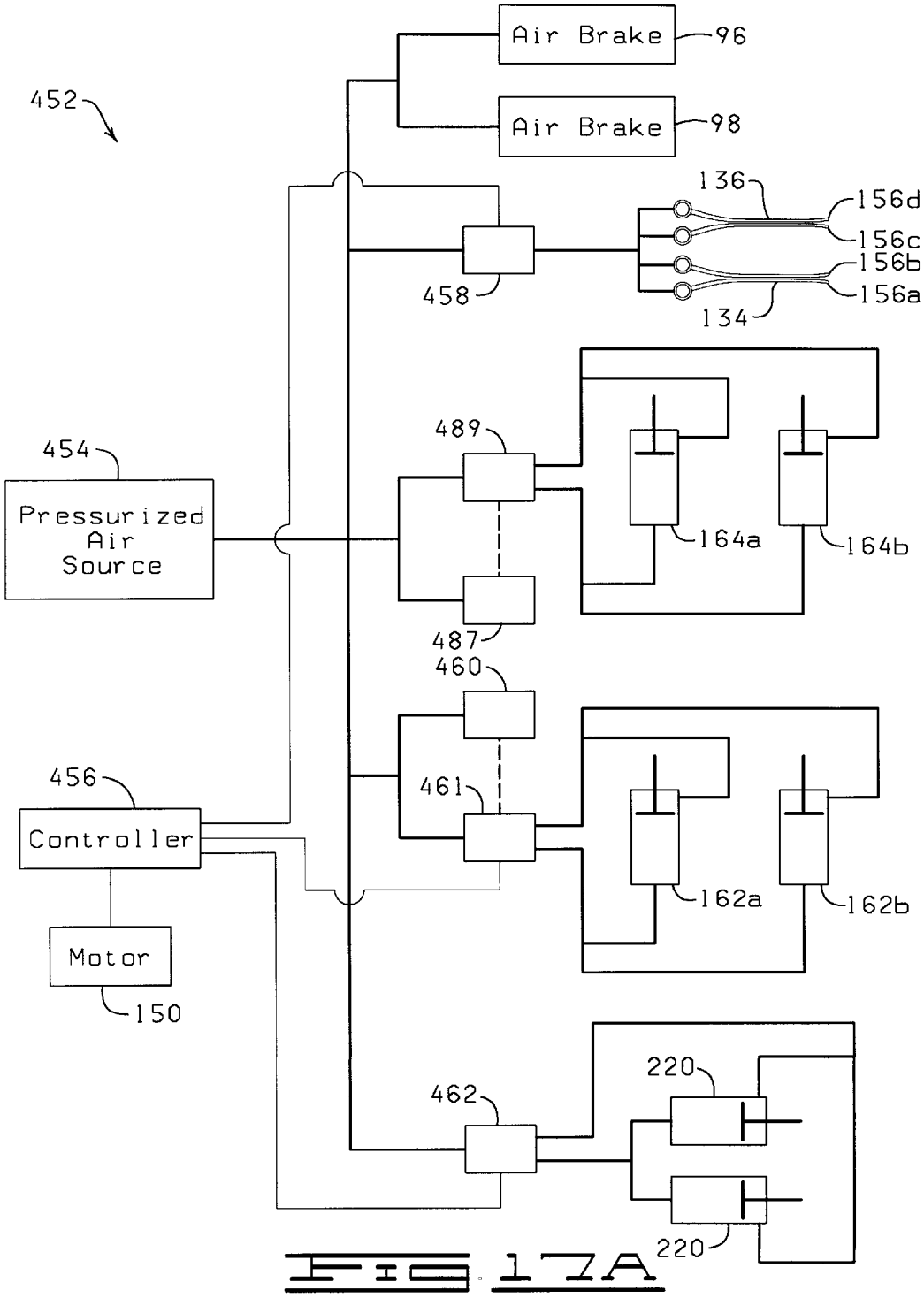
FIG. 17A is a schematic diagram of a portion of a control system employed in the article forming apparatus of the present invention.
Figure 17B:
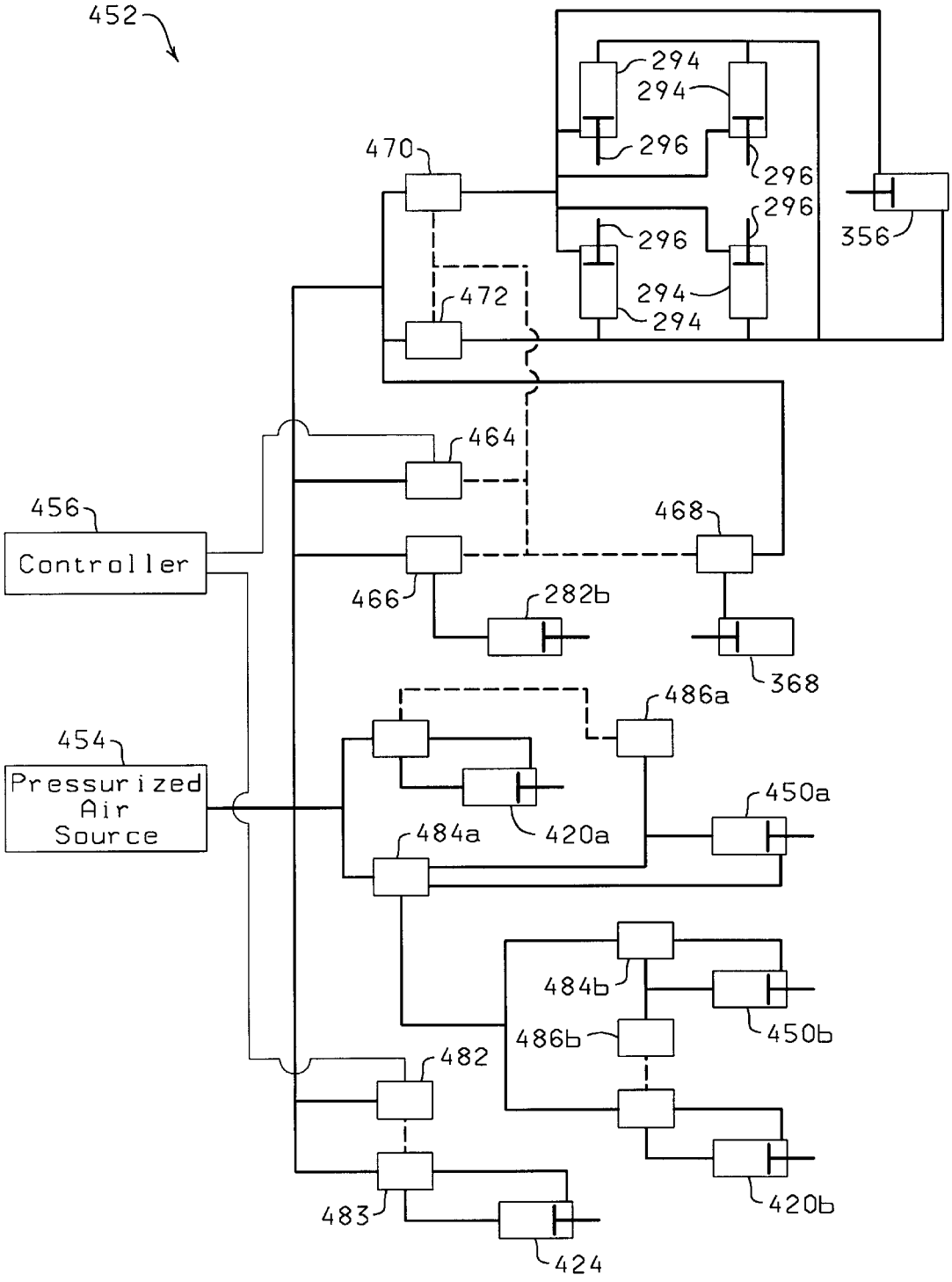
FIG. 17B is a schematic diagram of a portion of a control system employed in the article forming apparatus of the present invention.
Figure 17C:
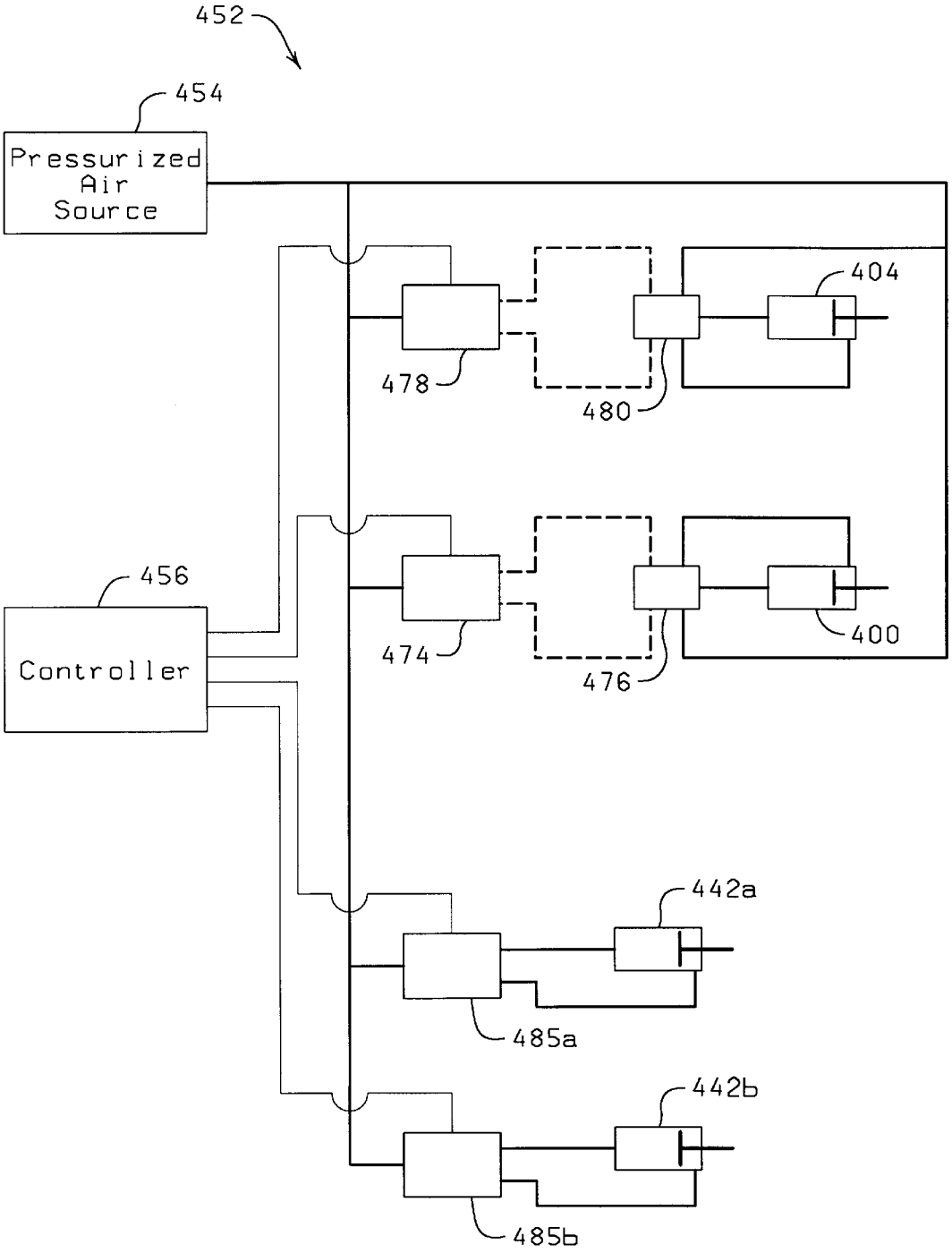
FIG. 17C is a schematic diagram of a portion of a control system employed in the article forming apparatus of the present invention.

Referring to FIGS. 17A–17C, a schematic illustration of one embodiment of a control system 452 for automatically operating the article forming apparatus 70 is shown. The control system 452 includes a pressurized air source 454, a plurality of control valves for controlling the mode of operation of the various cylinders described above, and a computerized controller 456 for outputting signals to such valves, as well as to the servo motors described above, at predetermined intervals so as to synchronize the operation of the various components of the article forming apparatus 70. Control valves and controllers constructed to operate in the manner described herein are well known in the art. Thus, a detailed description of such components is not believed necessary to enable one skilled in the art to understand the operation of the article forming apparatus 70 of the present invention.

1. Single Sheet Operation

The controller 456 is initially set up by inputting desired variables which include single or double sheet feeding, the length of the first sheet of material, the length of the second sheet of material (if applicable), the operating speed, the number of articles per production run, the number of articles per stack, and the length of time the male die is mated with the female die (dwell time). The temperature of the male and female dies 248 and 246 and the ejector member 281 is set via a temperature controller (not shown). The temperature controller can be incorporated into the controller 456 or alternatively set up as a separate unit.

When forming the flower pot cover 10, the first web of sheet material 84 provided by the first roll of sheet material 82 is initially fed over the rollers 114*a*, 116*a*, 100*a*, 118*a*, 119*a*, 120*a*, 121*a*, 122*a*, 124*a*, 126*a* and 128*a* as substantially shown in FIG. 6 and through the nip rollers 138. It will be appreciated that when forming the flower pot cover 10, which is fabricated from one sheet of material, the second roll of sheet material 88 shown in FIG. 6 need not be disposed on the second arbor 86. However, it will also be appreciated that the second roll of sheet material 88 may be set up so that the article forming apparatus 70 begins to utilize the second roll of sheet material 88 upon detecting that the first roll of sheet material 82 is spent.

Figure 7:
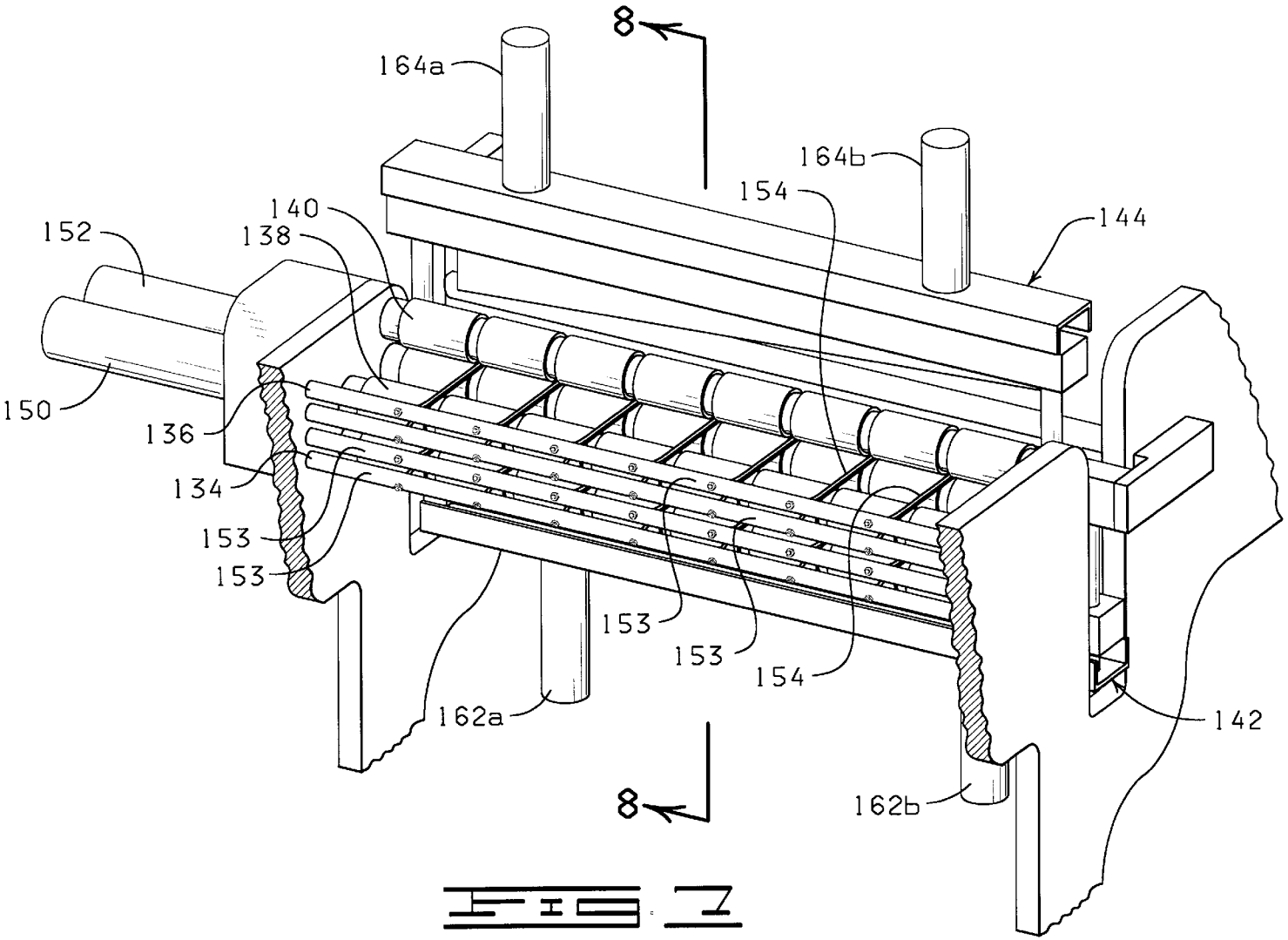
FIG. 7 is a perspective view of a portion of the article forming apparatus of the present invention illustrating the cutting and transfer assembly.

In operation, the controller 456 outputs a signal to the servo motor 150 to cause the servo motor 150 to drive the nip rollers 138 and the servo motor 190 is activated in a delayed manner by a timer (not shown) to cause the servo motor 190 to drive the conveyor assembly 148 so that the nip rollers 138 and the conveyor assembly 148 cooperate to advance the web of sheet material 84 through the first knife assembly 142 (FIGS. 6–8) until the leading edge of the web of sheet material 84 extends a predetermined distance beyond the first knife assembly 142. Also, upon the activation of the servo motor 150, a valve 458 (FIG. 17A) is opened to cause air to flow from the nozzles 156 to maintain the web of sheet material 84 in a flattened condition.

Upon advancing the web of sheet material 84 the predetermined distance, the servo motors 150 and 190 are de-energized, and the controller 456 outputs a signal to a valve 460 (FIG. 17A) which causes a pilot valve 461 to be operated so as to cause the cylinders 162*a*, 162*b* to extend and cause the first knife assembly 142 to be actuated so as to cut the web of sheet material 84 and form a sheet of material, such as the sheet of material 12 (FIG. 1) for forming the flower pot cover 10. After the sheet of material is formed to the desired length, the controller 456 outputs a signal to energize the servo motor 190 to actuate the conveyor assembly 148 and transport the cut sheet of material between the male die 248 and the female die 246. The controller 456 causes the servo motor 190 to be energized in response to the plate member 371 passing the upper proximity switch 369 (FIG. 13).

Figure 15C:
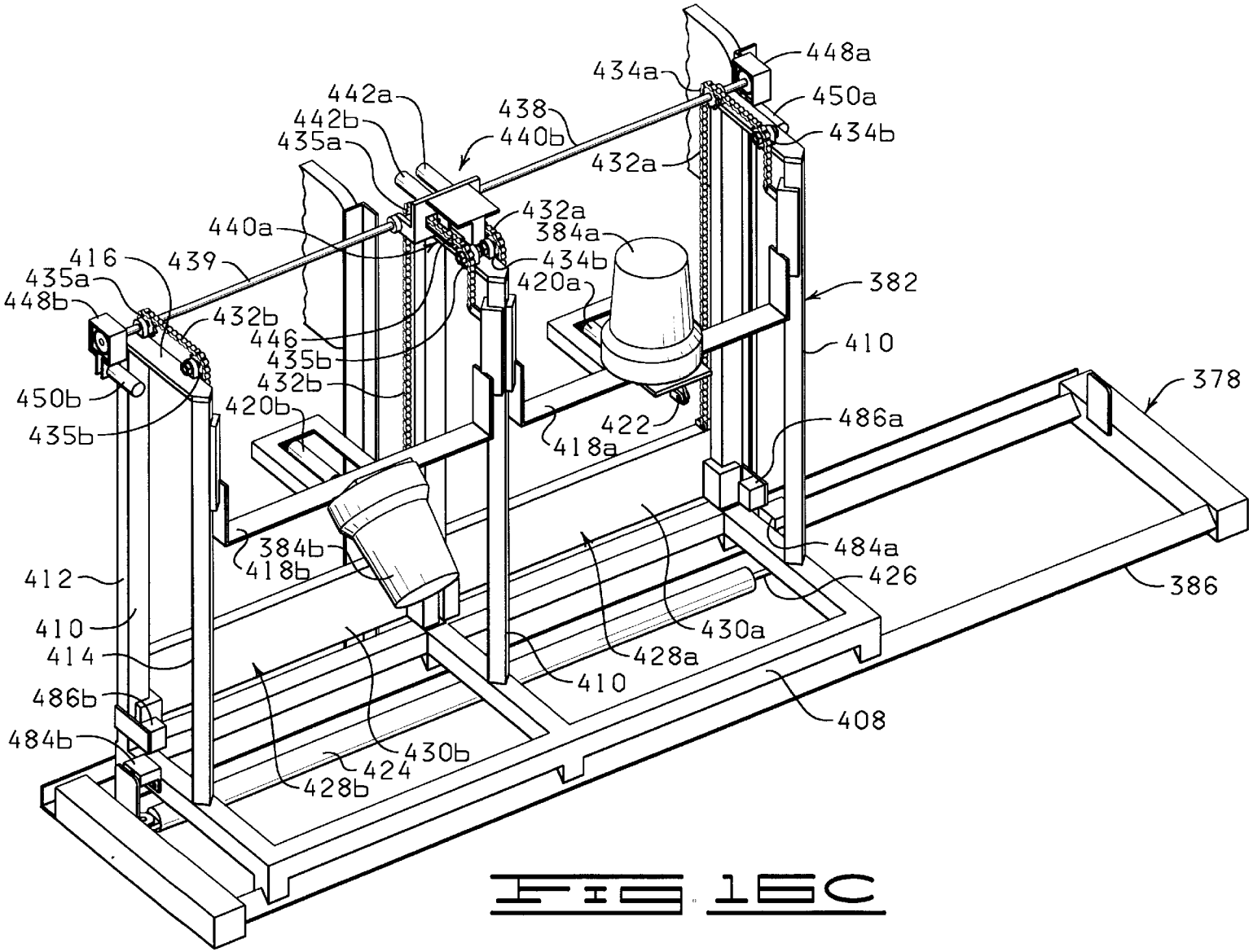

The controller 4S6 de-energizes the servo motor 190 upon the servo motor 190 completing the number of revolutions required to position the cut sheet of material over the female die 246. Upon the servo motor 190 completing the required number of revolutions, several components are simultaneously actuated to enable a flower pot cover 10 to be formed. The controller 456 outputs a signal to a valve 462 to cause the cylinders 220 to extend so as to raise the holddown rails 214 and release the cut sheet of material. The controller 456 additionally outputs a signal to the valve 288 to activate the vacuum in the support surface 283 to hold the sheet of material to the support surface 283. Finally, the controller 456 outputs a signal to a valve 464 to cause the cylinder 282*b* (FIG. 12) and the cylinder 368 (FIGS. 14 and 15) to be de-energized, the cylinder 356 to extend so as to force the male die 248 from the discharge position to the forming position, and the rods 296 of the cylinders 294 to extend so that the rods 296 cooperate with the material guides 292 to initiate folds in the cut sheet of material. More specifically, when the controller 456 closes the valve 464, pilot air is blocked from pilot valves 466, 468, 470, and 472. The pilot valve 466 is interposed between the cylinder 282*b* and the air source 454 and is closed when pilot air is not passed thereto thus resulting in the cylinder 282*b* being de-energized and thus movable to a retracted position. The pilot valve 468 is interposed between the cylinder 368 and the air source 454 and is closed when pilot air is not passed thereto also resulting in the cylinder 368 being de-energized and thus movable to an extended position. The pilot valves 470 and 472 are interposed between the cylinders 294 and the cylinder 356 and the air source 454. When pilot air is not passed to the pilot valve 472 the pilot valve 472 remains open while the pilot valve 470 remains closed, thus resulting in the passage of air to cylinders 294 to cause the rods 296 to be extended and passage of air to the cylinder 356 to cause the cylinder 356 to extend.

The heating elements 316 in the male die 248 and the heating elements 278 in the female die 246 each are connected to the electrical power source 279 so the heating elements 316 cooperate to heat the male die surface 302 to the predetermined temperature level and the heating elements 278 in the female die 246 cooperate to heat the female die surface 256 to the predetermined temperature level.

Because the openings 286 in the material holddown areas 284 are in communication with the vacuum source 274, the portions of the sheet of material generally near each of the corners of the sheet of material are biased or pulled generally toward the respective material holddown areas 284 when the sheet of material initially is placed or positioned on the support surface 283. The amount of vacuum applied through the openings 286 is relatively slight so the vacuum tends to bias or pull the portions of the sheet of material generally near the corners toward the respective material holddown areas 284, yet the vacuum is small enough to permit the corner portions of the sheet of material to be pulled across the respective material holddown areas 284 toward the opening 254 in the female die 246 during the forming of the flower pot cover 10.

As the male die 248 moves in a downward direction, the male die 248 moves to a position wherein the lower end 300 of the male die 248 (the lower end of the base portion 304) initially engages the portion of the sheet of material disposed over the opening 254 in the female die 246. The male die 248 continues to move in the downward direction to the forming position wherein the male die surface 302 is matingly disposed with the female die 246 with the lower end 300 of the male die 248 being disposed generally near the lower end 252 of the female die 246 with portions of the sheet of material being disposed generally about the male die surface 302 and generally between the male die surface 302 and the female die surface 256. The vacuum applied through the openings 286 in the material holddown areas 284 permit the portions of the sheet of material disposed on the material holddown areas 284 to be biased toward the material holddown areas 284 and yet to be slidingly moved in the direction generally toward the opening 254 in the female die 246 as the male die 248 engages the sheet of material and pushes the sheet of material into the opening 254 as the male die 248 is moved to the forming position.

In the forming position of the male die 248 within the opening 254 of the female die 246, the base portion 258 of the female die 246 cooperates with the base portion 304 of the male die 248 to form the portion of the sheet of material disposed therebetween into the base 14 of the flower pot cover 10. The flared portion 264 of the female die 246 cooperates with the flared portion 310 of the male die 248 to form the portion of the sheet of material disposed therebetween into the lower portion of the decorative border 22 generally adjacent the upper end of the base 14, thereby establishing or forming the angle at which the decorative border 22 extends upwardly and outwardly from the opened upper end 16 of the base 14. The four flared petal-like portions 24 of the decorative border 22 are disposed on the respective material holddown areas 284 during the forming of the pot cover 10.

In the forming position, the plate member 371 triggers the lower proximity switch 370 (FIGS. 13 and 14) thereby terminating the vacuum in the female die 246 and initiating the timing sequence that maintains the male die 248 in the female die 246 for a predetermined length of time. The amount of time the male die remains in the forming position (dwell time) can be set to vary from about 0.1 seconds to about 10 seconds depending on the type of sheet material being utilized in the operation.

Upon the expiration of the dwell time, the controller 456 sends a signal to the valve 314 (FIG. 12) so as to cause the vacuum to be directed to the male die 248, and the controller 456 sends a signal to the valve 276 to cause blower air to be directed to the openings 270 and 271 in the female die 246 so that the formed flower pot cover 10 is held against the male die 248. At the same time, the vacuum and blower are activated in the male and female dies 248, 246, respectively, the controller 456 sends a signal to the valve 464 to cause the cylinder 282*b* to extend, the cylinder 356 to retract, the cylinder 368 to retract, and the cylinders 294 to retract. More specifically, when the controller opens the valve 464, pilot air is passed to pilot valves 466, 468, 470, and 472. The pilot valve 466 is opened when pilot air is passed thereto thus resulting in the cylinder 368 being energized and extended. The pilot valve 468 is opened when pilot air is passed thereto resulting in the cylinder 368 being energized so that the cylinder is retractable in the manner described below. When pilot air is passed to the pilot valves 470 and 472, the pilot valve 472 is closed while the pilot valve 470 is opened, thus resulting in the passage of air to cylinders 294 to cause the rods 296 to be retracted below the support surface 283 and the passage of air to the cylinder 356 to cause the cylinder 356 to retract. The retraction of the cylinder 356 and the extension of the cylinder 282*b* cooperate to remove the male die 248 from the female die 246 with the formed flower pot cover 10 disposed thereon.

The male die 246 continues in an upward direction with the rollers 350 on the second end 328 of the support shaft 322 traveling along the vertical portion 352 of the guide slot 348 of the cam plate 346. When the rollers 350 enter the Y-shaped portion 354 of the guide slot 348 in the cam plate 346, the rod 366 of the cylinder 368 is able to retract so as to rotate the male die 248 to the discharge position.

When the male die 248 reaches the horizontal discharge position, the upper proximity switch 369 is triggered. With the male die 248 in the horizontal discharge position and with the formed flower pot cover 10 disposed thereon, the controller 456 outputs a signal to a valve 474 (FIG. 17C) which causes a pilot valve 476 to be operated so as to cause the cylinder 400 and thus the transfer cup 380 to be extended about the flower pot cover 10 and the male die 248. With the transfer cup 380 extended, the proximity switch 411*b* (FIG. 16A) is tripped which in turn directs the controller 456 to output a signal to the valve 314 (FIG. 12) to cause the vacuum on the male die 248 to be terminated, a signal to the valve 315 and the valve 315*a* (FIG. 12) to cause blower air and compressed air to be directed to the male die 248, and a signal to the valve 394 (FIG. 16A) to cause a vacuum to be drawn in the transfer cup 380 whereby the flower pot cover 10 is biased against the transfer cup 380. After a predetermined time delay, the controller 456 outputs a signal to the valve 474 (FIG. 17C) to cause the cylinder 400 and the transfer cup 380 to retract with the flower pot cover 10 disposed in the transfer cup 380.

When the transfer cup 380 is fully retracted, the proximity switch 411*a* (FIG. 16A) is tripped thereby directing the controller 456 to output a signal to a valve 478 (FIG. 17C) which causes a pilot valve 480 to be operated so as to cause the cylinder 404 to retract which causes the transfer cup 380 to rotate to the vertical position (FIG. 16B) where the transfer cup 380 is aligned with one of the stacking shells 384*a* or 384*b* (FIG. 16C) of the stacking shell support frame 382 so that the flower pot cover 10 held by the transfer cup 380 can be disposed onto one of the stacking shells 384*a* or 384*b*. When in the vertical position, the proximity switch 415*b* is tripped thereby directing the controller 456 to output a signal to the valve 474 (FIG. 17C) to cause the cylinder 400 to extend thereby moving the transfer cup 380 downward onto the stacking shell 384*a* or 384*b* aligned therewith. Once the transfer cup 380 is positioned on the stacking shell 384*a* or 384*b*, the proximity switch 411*b* (FIG. 16A) is tripped thereby directing the controller 456 to output a signal to the valve 394 to terminate the vacuum in the transfer cup 380 and direct the blower air to the transfer cup 380. Simultaneously, the controller 456 outputs a signal to the valve 474 to cause the cylinder 400 to retract thus leaving the flower pot cover 10 on the stacking shell 384*a* or 384*b*. When the transfer cup 380 is fully retracted, the proximity switch 411*a* is tripped thereby directing the controller 456 to output a signal to the valve 478 to cause the cylinder 404 to extend which in turn causes the transfer cup 380 to rotate to the horizontal position whereby the proximity switch 415*a* (FIG. 16A) is tripped indicating that the transfer cup 380 is ready to accept another flower pot cover 10 from the male die 248.

When the male die 248 reaches the forming position, a new cycle commences with the nip rollers 138 and the conveyor assembly 148 being actuated to advance the web of sheet material 84 through the first knife assembly 142 to form another sheet of material. More particularly, when the male die 248 reaches the forming position, the lower proximity switch 370 (FIG. 13) is tripped thereby directing the controller 456 to energize the servo motor 150 so as to actuate the nip rollers 138 and advance the web of sheet material 84 for cutting. It should be noted that web of sheet material 84 is cooperatively advanced beyond the first knife assembly 142 by the nip rollers 138 and the conveyor assembly 148 while the male die 248 is in the forming position and thus the holddown rails 214 are in the release position. Although the holddown rails 214 are in the release position, the web of sheet material 84 is advanced beyond the first knife assembly 142 by the sheet receiving portions 167*a* and 169*a* of the first and second conveyor assemblies 166 and 168, respectively, which remain in a sheet gripping relationship even when the holddown rails 214 are in the release position.

The stacking of flower pot covers 10 on one of the stacking shells 384*a*, for example, is continued with the stacking shell 384*a* or 384*b* being lowered by the ratchet assembly 440*a* or 440*b* after a predetermined number of cycles. After the predetermined number of cycles, the controller 456 outputs a signal to a valve 485*a* or a valve 485*b* (FIG. 17C) to cause the pawl 446 (FIG. 16C) to be extended so as to move the respective chain. When a full stack is achieved, the controller 456 outputs a signal to a valve 482 (FIG. 17B) which causes a pilot valve 483 to activate the cylinder 424 to shift the stacking shell support frame 382 laterally. The lateral shifting of the stacking shell support frame 382 causes an air switch 484*a* or 484*b* (FIGS. 16C and 17B) positioned on the base portion 408 of the stacking shell support frame 382 to be engaged which in turn causes the cylinder 450*a* or 450*b* (FIGS. 16C and 17B) to extend and release the shoe brake 448*a* or 448*b* to allow the weight member 430*a* or 430*b* to drop and thus raise the stacking shell 384*a* or 384*b* to the up position with the stack of flower pot covers disposed thereon. When the weight member 430*a* or 430*b* reaches a down position, the weight member 430*a* or 430*b* engages an air switch 486*a* or 486*b* (FIGS. 16C and 17B) which causes the cylinder 420*a* or 420*b* (FIGS. 16A and 17B) to retract and thus tilt the stacking shell 384*a* or 384*b* forward thereby dumping the stack of flower pot covers 10 onto a conveyor belt (not shown).

2. Double Sheet Operation

The flower pot cover 40 is formed and stacked in an identical manner as described above in reference to the forming of the flower pot cover 10, except that the flower pot cover 40 is fabricated from two layered sheets of material rather than only one sheet of material and thus requires the simultaneous use of the first roll of sheet material 82 and the second roll of sheet material 88. When forming the flower pot cover 40, the first web of sheet material 84 and the second web of sheet material 90 are initially fed over the respective set of rollers as substantially shown in FIG. 6.

As described above, the embodiment of the flower pot cover 40 depicted in FIG. 2 is fabricated from a second sheet of material which extends a distance outwardly from the outer peripheral edge of a first sheet of material when the second sheet of material is concentrically positioned on the first sheet of material. To form the flower pot cover 40 shown in FIG. 2, the second web of sheet material 90 (FIG. 6) is provided with a width greater than the first web of sheet material 84. By way of example, the first web of sheet material 84 could have a width of 20 inches and the second web of sheet material 90 could have a width of 24 inches whereby the second web of sheet material 90 extends two inches beyond each side of the first web of material 84.

Figure 18A:
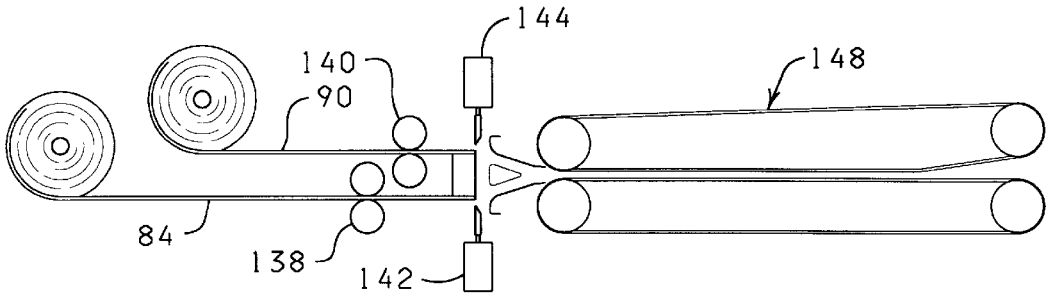
FIGS. 18A–18F are schematic representations of a portion of the article forming apparatus of the present invention illustrating the sequential operation of the article forming apparatus in forming an article constructed of two sheets of material.
Figure 18B:
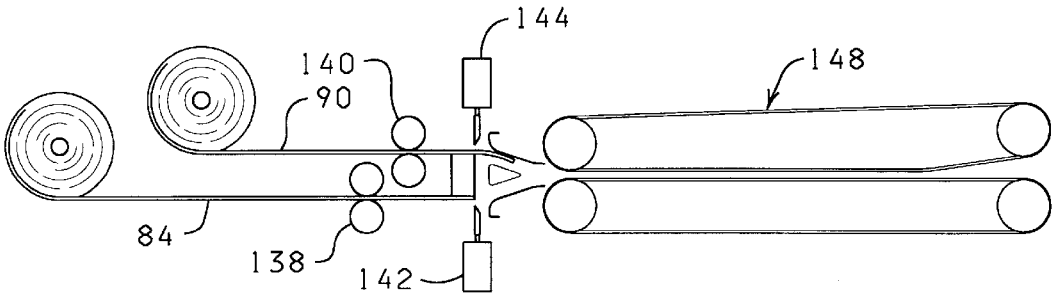
Figure 18C:
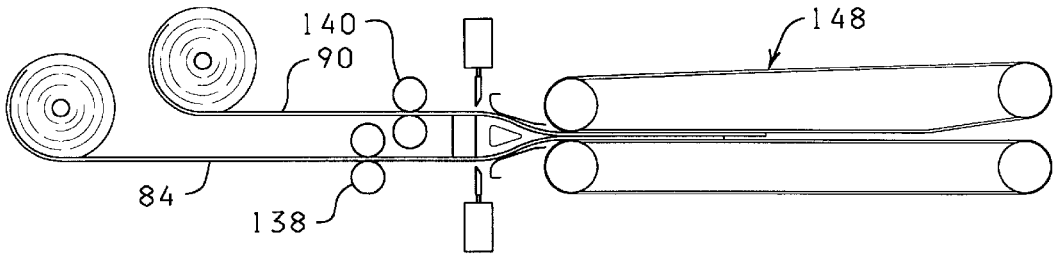
Figure 18D:
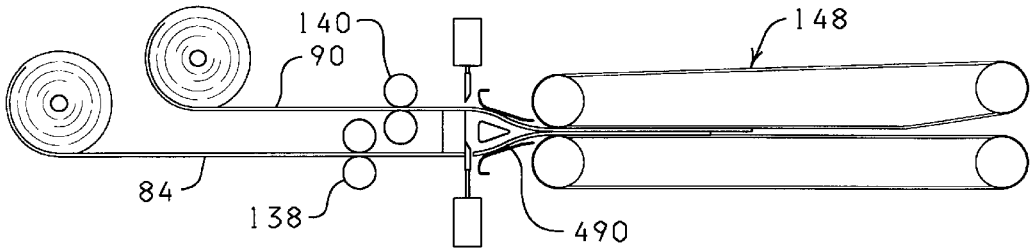
Figure 18E:
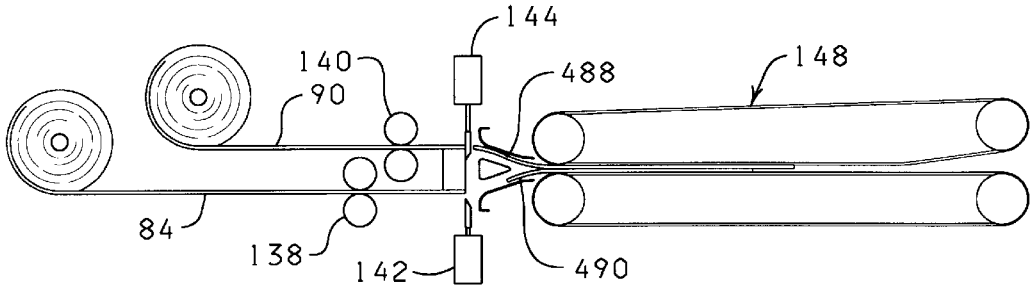
Figure 18F:
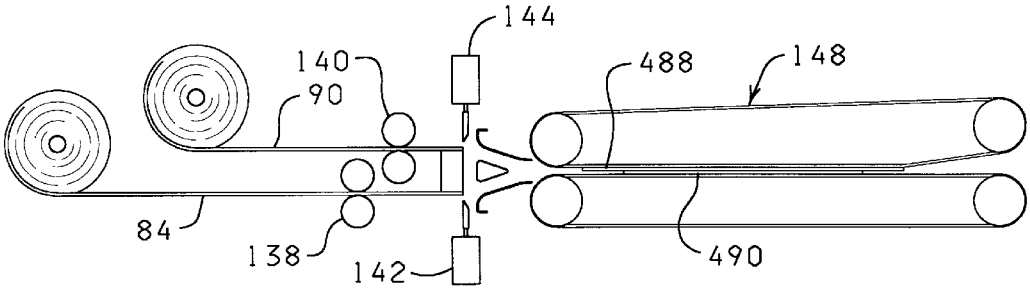

To achieve this same relation with the leading and trailing edges of the first and second sheet of material formed from the first and second webs of sheet material 84 and 90, the controller 456 outputs a signal to the servo motor 150 to cause the second web of sheet material 90 to be advanced two inches by the nip rollers 140 (FIG. 18B). Next, the controller 456 outputs a signal to the servo motor 150 and the servo motor 152 to cause the first and second webs of sheet material 84 and 90 to be advanced 20 inches by the first and second nip rollers 138 and 140, respectively (FIG. 18C). Upon the servo motors 150 and 152 completing the required number of revolutions, the controller 456 outputs a signal to the valve 460 to cause the first web of sheet material 84 to be cut by the first knife assembly 142 so as to form a first sheet of material 490 (FIG. 18D). With the first sheet of material 490 formed, the controller 456 outputs a signal to the servo motor 150 to cause the second web of sheet material 90 and the first sheet of material 490 to be advanced an additional two inches at which time the controller 456 outputs a signal to a valve 487 (FIG. 17A) which causes a pilot valve 489 to be operated so as to cause the cylinders 164*a* and 164*b* to extend and cause the second web of sheet material 90 to be cut by the second knife assembly 144 to form a second sheet of material 488. The result is the first sheet of material 490 being concentrically positioned on the second sheet of material 488 with the peripheral edge of the second sheet of material 488 extending two inches beyond the peripheral edge of the first sheet of material 490. With the first sheet of material 490 concentrically positioned on the second sheet of material 488, the first and second sheets of material 490 and 488 are positioned over the female die 246 by the conveyor assembly 148 (FIG. 18F), formed into the flower pot cover 40, and stacked in the same manner described above in reference to the forming and stacking of the flower pot cover 10.

As previously mentioned, it will also be appreciated that a flower pot cover constructed of more than one sheet of material is not limited to the construction described above. For example, the sizes of the sheets of material can be varied so that the first sheet of material is larger than the second sheet of material or so that the first and second sheets of material are of identical size.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A method for forming an article, the method comprising the steps of:

positioning a sheet of material between a male die and a female die, the male die having an upper end, a lower end, and an outer peripheral male die surface extending a distance generally between the lower end and the upper end of the male die, the female die having an upper end, a lower end and an inner peripheral female die surface defining an opening intersecting the upper end and extending a distance toward the lower end, the opening of the female die sized to receive at least a portion of the male die, the female die formed of a plurality of female die segments which are radially moveable between an open position wherein the female die segments of the female die are radially spaced apart to receive the male die with the female die surface and the male die surface being substantially aligned and in a non-engaging relation and a closed position wherein the inner peripheral female die surface of the female die segments are radially brought together into engagement with the male die surface;

positioning the female die segments in the open position;

positioning the male die into a forming position, wherein the male die is positioned in the opening of the female die, with the female die segments in the open position such that a portion of the sheet of material is disposed generally about the male die surface and generally between the male die surface and the female die surface with the female segments in a non-engaging relation with respect to the male die surface; and moving the female die segments to the closed position subsequent to the male die being positioned in the forming position such that the female die segments exert inward radial pressure against the sheet of material and the male die surface thereby pressing the sheet of material between the female die surface and the male die surface to form the article from the sheet of material.

2. The method of claim 1 further comprising:

moving the female die segments to the open position;

holding the formed article against the male die; and withdrawing the male die from the opening of the female die to remove the formed article from the opening of the female die.

* * * * *